US009165695B2

(12) United States Patent
Muramatsu et al.

(10) Patent No.: US 9,165,695 B2
(45) Date of Patent: Oct. 20, 2015

(54) COPPER ALLOY WIRE AND METHOD FOR PRODUCING THE SAME

(75) Inventors: Naokuni Muramatsu, Nagoya (JP); Hisamichi Kimura, Sendai (JP); Akihisa Inoue, Sendai (JP)

(73) Assignees: NGK Insulators, Ltd., Nagoya (JP); Tohoku University, Sendai-Shi (JP)

( * ) Notice: Subject to any disclaimer, the term of this patent is extended or adjusted under 35 U.S.C. 154(b) by 803 days.

(21) Appl. No.: 13/391,139

(22) PCT Filed: Sep. 13, 2010

(86) PCT No.: PCT/JP2010/065767

§ 371 (c)(1),
(2), (4) Date: Feb. 17, 2012

(87) PCT Pub. No.: WO2011/030898

PCT Pub. Date: Mar. 17, 2011

(65) Prior Publication Data

US 2012/0148441 A1 Jun. 14, 2012

Related U.S. Application Data

(60) Provisional application No. 61/372,185, filed on Aug. 10, 2010.

(30) Foreign Application Priority Data

Sep. 14, 2009 (JP) ..... 2009-212053

(51) Int. Cl.
*H01B 1/02* (2006.01)
*C22C 1/02* (2006.01)
(Continued)

(52) U.S. Cl.
CPC *H01B 1/026* (2013.01); *C22C 1/02* (2013.01); *C22C 9/00* (2013.01); *C22F 1/08* (2013.01)

(58) Field of Classification Search
CPC ..... C22C 1/02; C22C 9/00; C22C 1/08; H01B 1/026; B21C 1/00; B21C 1/003
USPC ..... 420/492; 148/553, 554; 164/66.1, 76.1
See application file for complete search history.

(56) References Cited

U.S. PATENT DOCUMENTS 4,489,136 A * 12/1984 Bose et al. ..... 428/606
5,077,005 A 12/1991 Kato
(Continued)

FOREIGN PATENT DOCUMENTS

CN 1329540 C 8/2007
EP 1 582 602 A2 10/2005
(Continued)

OTHER PUBLICATIONS

T. P. Weihs, et al, "Hardness, Ductility, and Thermal Processing of Cu/Zr and Cu/Cu—Zr Nanoscale Multilayer Foils," ACTA Materialia, vol. 45, No. 6, Jun. 1, 1997, pp. 2307-2315.
(Continued)

*Primary Examiner* — Keith Walker
*Assistant Examiner* — John Hevey
(74) *Attorney, Agent, or Firm* — Burr & Brown, PLLC

(57) ABSTRACT

The zirconium content of the alloy composition of a copper alloy wire is 3.0 to 7.0 atomic percent; and the copper alloy wire includes copper matrix phases and composite phases composed of copper-zirconium compound phases and copper phases. The copper matrix phases and the composite phases form a matrix phase-composite phase fibrous structure and are arranged alternately parallel to an axial direction as viewed in a cross-section parallel to the axial direction and including a central axis. The copper-zirconium compound phases and the copper phases in the composite phases also form a composite phase inner fibrous structure and are arranged alternately parallel to the axial direction at a phase pitch of 50 nm or less as viewed in the above cross-section. This double fibrous structure presumably makes the copper alloy wire densely fibrous to provide a strengthening mechanism similar to the rule of mixture for fiber-reinforced composite materials.

21 Claims, 15 Drawing Sheets

(51) Int. Cl.
*C22C 9/00* (2006.01)
*C22F 1/08* (2006.01)

(56) References Cited

U.S. PATENT DOCUMENTS

| | | | | |
|---|---|---|---|---|
| 5,705,125 | A * | 1/1998 | Goto et al. | 420/470 |
| 5,917,158 | A | 6/1999 | Takao et al. | |
| 6,022,426 | A * | 2/2000 | Mennucci et al. | 148/527 |
| 6,458,223 | B1 | 10/2002 | Thieme et al. | |
| 2005/0211346 | A1 | 9/2005 | Kimura et al. | |

FOREIGN PATENT DOCUMENTS

| | | | |
|---|---|---|---|
| JP | 2000-160311 | A1 | 6/2000 |
| JP | 2001-518681 | A1 | 10/2001 |
| JP | 2005-133185 | A1 | 5/2005 |
| JP | 2005-281757 | A1 | 10/2005 |
| WO | 99/17307 | A1 | 4/1999 |

OTHER PUBLICATIONS

Extended European Search Report, corresponding EP Application No. 0815489.9, dated Jul. 19, 2013.

Rong-de Li, et al., "Effect of Solidification Parameters on Dendrite Arm Space and Tensile Strength of Alloy ZA27," Materials Science & Technology, Jun. 2001, vol. 9, No. 2, pp. 199-202.

Chen-Xi Li, et al., "Research on Secondary Dendrite Arm Spacing," Foundry, Dec. 2004, vol. 53, No. 12, pp. 1011-1014.

Chinese Office Action (Application No. 201080037550.0) dated May 14, 2014.

U.S. Appl. No. 13/391,847, filed Feb. 17, 2012, Muramatsu et al.

H. Kimura et al., "Ultrahigh Strength and High Electrical Conductivity Characteristics of Cu—Zr Alloy Wires with Nanoscale Duplex Fibrous Structure," Materials Transactions, The Japan Inst. of Metals, vol. 47, No. 6, Jun. 15, 2006, pp. 1595-1598.

H. Kimura et al., "Effect of Cold Drawing on Electrical and Mechanical Properties of Cu-5 at% Zr Alloy," Materials Transactions, The Japan Inst. of Metals, vol. 48, No. 10, Aug. 29, 2007, pp. 2674-2678.

J.H. Swisher et al., "Dispersion-Strengthing of Copper by Internal Oxidation of Two-Phase Copper-Zirconium Alloys," Journal of the Institute of Metals, May 1970, vol. 98, pp. 129-133.

Extended European Search Report dated Jul. 5, 2013.

Hisamichi Kimura et al., "Mechanical Properties and Electrical Conductivity of Heavily Cold-Rolled $Cu_{100-x}Zr_x$ alloys (x=0-8)," Materials Transactions, vol. 46, No. 7 (2005) pp. 1733-1736.

International Search Report and Written Opinion dated Dec. 7, 2010.

* cited by examiner

| Cu (at%) | Zr (at%) |
|---|---|
| 99.7 | 0.3 |

| Cu (at%) | Zr (at%) |
|---|---|
| 93.1 | 6.9 |

COPPER ALLOY WIRE AND METHOD FOR PRODUCING THE SAME

BACKGROUND OF THE INVENTION

1. Technical Field

The present invention relates to copper alloy wires and methods for producing copper alloy wires.

2. Description of Related Art

Known copper alloys for wires include copper-zirconium alloys. For example, PTL 1 proposes a copper alloy wire with improved electrical conductivity and ultimate tensile strength produced by subjecting an alloy containing 0.01% to 0.50% by weight of zirconium to solution treatment, drawing the alloy to the final diameter, and subjecting the wire to predetermined aging treatment. This copper alloy wire has $Cu_3Zr$ precipitated in copper matrix phases to achieve a high strength up to 730 MPa. In PTL 2, on the other hand, the present inventors have proposed a copper alloy containing 0.05 to 8.0 atomic percent of zirconium and having a two-phase structure in which copper matrix phases and eutectic phases of copper and a copper-zirconium compound are layered on top of each other and in which the adjacent copper matrix phase crystal grains contact intermittently, thus achieving a high strength up to 1,250 MPa.

CITATION LIST

Patent Literature

PTL 1: JP 2000-160311 A
PTL 2: JP 2005-281757 A

DISCLOSURE OF INVENTION

However, the copper alloy wires disclosed in PTLs 1 and 2 may have insufficient ultimate tensile strength, for example, if they are thinned, and there is therefore a need for a higher strength.

A main object of the present invention, which has been made to solve the above problem, is to provide a copper alloy wire with increased ultimate tensile strength.

As a result of an intensive study for achieving the above object, the present inventors have found that a copper alloy wire with high strength can be achieved by casting a copper alloy containing 3.0 to 7.0 atomic percent of zirconium into a bar-shaped ingot having a diameter of 3 to 10 mm using a pure copper mold and drawing the ingot to a reduction of area of 99.00% or more, thus completing the present invention.

The present invention provides a copper alloy wire comprising: copper matrix phases; and composite phases comprising copper-zirconium compound phases and copper phases; wherein the zirconium content of alloy composition is 3.0 to 7.0 atomic percent; the copper matrix phases and the composite phases form a matrix phase-composite phase fibrous structure and are arranged alternately parallel to an axial direction as viewed in a cross-section parallel to the axial direction and including a central axis; and the copper-zirconium compound phases and the copper phases in the composite phases form a composite phase inner fibrous structure and are arranged alternately parallel to the axial direction at a phase pitch of 50 nm or less as viewed in the cross-section.

The present invention also provides a copper alloy wire comprising: copper matrix phases; and composite phases comprising copper-zirconium compound phases and copper phases; wherein the zirconium content of alloy composition is 3.0 to 7.0 atomic percent; and the composite phases contain 5% to 25% of amorphous phases in terms of area fraction as viewed in a cross-section parallel to an axial direction and including a central axis.

The present invention further provides a method for producing a copper alloy wire, comprising: (1) a melting step of melting a raw material so as to prepare a copper alloy containing 3.0 to 7.0 atomic percent of zirconium; (2) a casting step of casting the melt into an ingot having a secondary dendrite arm spacing (secondary DAS) of 10.0 μm or less; and (3) a wire drawing step of cold-drawing the ingot to a reduction of area of 99.00% or more.

The present invention still further provides a method for producing a copper alloy wire, comprising: (1) a melting step of melting a raw material so as to prepare a copper alloy containing 3.0 to 7.0 atomic percent of zirconium; (2) a casting step of casting the melt into a bar-shaped ingot having a diameter of 3 to 10 mm using a copper mold; and (3) a wire drawing step of cold-drawing the ingot to a reduction of area of 99.00% or more.

These copper alloy wires have increased ultimate tensile strength. Although the reason for this effect remains uncertain, presumably the double fibrous structure, namely, the matrix phase-composite phase fibrous structure and the composite phase inner fibrous structure, makes the copper alloy wire densely fibrous to provide a strengthening mechanism similar to the rule of mixture for fiber-reinforced composite materials. Alternatively, presumably the amorphous phases present in the composite phases provide some strengthening mechanism.

DETAILED DESCRIPTION OF THE INVENTION

Figure 1:
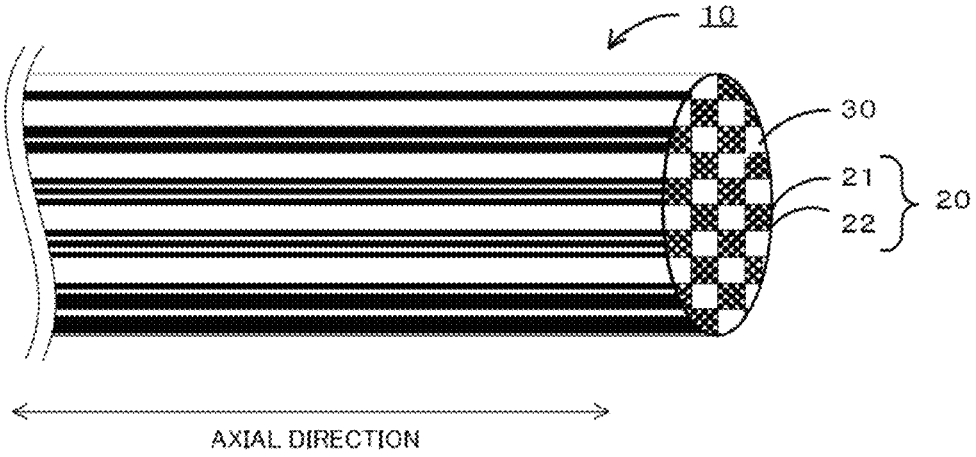
FIG. 1 is an illustration showing an example of a copper alloy wire 10 of the present invention.
Figure 2:
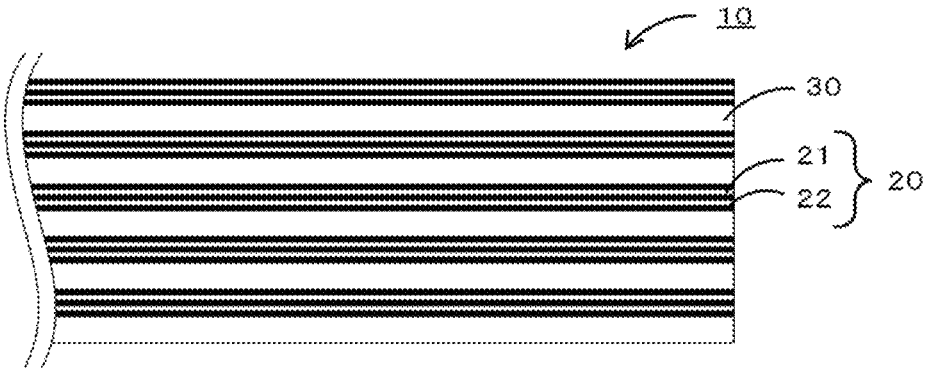
FIG. 2 is an illustration showing an example of a cross-section of the copper alloy wire 10 of the present invention parallel to the axial direction and including the central axis.
Figure 3:
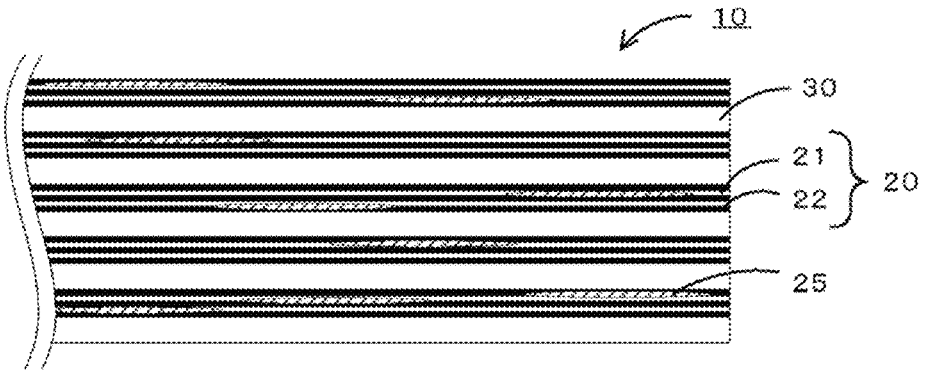
FIG. 3 is an illustration showing an example of a cross-section of the copper alloy wire 10 of the present invention parallel to the axial direction and including the central axis.

A copper alloy wire of the present invention will now be described with reference to the drawings. FIG. 1 is an illustration showing an example of a copper alloy wire 10 of the present invention, and FIGS. 2 and 3 are each an illustration showing an example of a cross-section of the copper alloy wire 10 of the present invention parallel to the axial direction and including the central axis. The copper alloy wire 10 of the present invention includes copper matrix phases 30 and composite phases 20 composed of copper-zirconium compound phases 22 and copper phases 21. In the copper alloy wire 10 of the present invention, the copper matrix phases 30 and the composite phases 20 form a matrix phase-composite phase fibrous structure and are arranged alternately parallel to the axial direction as viewed in a cross-section parallel to the axial direction and including the central axis.

The copper matrix phases 30 are formed of proeutectic copper and form the matrix phase-composite phase fibrous structure together with the composite phases 20. These copper matrix phases 30 increase the electrical conductivity.

The composite phases 20 are composed of the copper-zirconium compound phases 22 and the copper phases 21 and form the matrix phase-composite phase fibrous structure together with the copper matrix phases 30. In these composite phases 20, additionally, the copper-zirconium compound phases 22 and the copper phases 21 form a composite phase inner fibrous structure and are arranged alternately parallel to the axial direction at a phase pitch of 50 nm or less as viewed in a cross-section parallel to the axial direction and including the central axis. The copper-zirconium compound phases 22 are formed of a compound represented by the general formula $Cu_9Zr_2$. The phase pitch may be 50 nm or less, preferably 40 nm or less, more preferably 30 nm or less. This is because a phase pitch of 50 nm or less further increases the ultimate tensile strength. On the other hand, the phase pitch is preferably larger than 7 nm, and in view of facilitating production, more preferably 10 nm or more, further preferably 20 nm or more. The phase pitch can be determined as follows. First, a wire thinned by argon ion milling is prepared as a sample for STEM observation. Next, a region where eutectic phases can be recognized in the central region, serving as a representative region, is observed at a magnification of 500,000 times or more, for example, 500,000 or 2,500,000 times, and scanning electron microscopy high-angle annular dark-field images (STEM-HAADF images) are acquired, for example, in three fields of view of 300 nm×300 nm for a magnification of 500,000 times or in ten fields of view of 50 nm×50 nm for a magnification of 2,500,000 times. Then, the widths of all copper-zirconium compound phases 22 and copper phases 21 whose widths can be examined in the STEM-HAADF images are measured, are added together, and are divided by the total number of copper-zirconium compound phases 22 and copper phases 21 whose widths were measured to calculate the average thereof as the phase pitch. Preferably, the copper-zirconium compound phases 22 and the copper phases 21 are arranged alternately at a substantially regular pitch in view of increasing the ultimate tensile strength.

The composite phases 20 preferably contain 5% to 35%, more preferably 5% to 25%, of amorphous phases in terms of area fraction as viewed in a cross-section parallel to the axial direction and including the central axis. That is, the area fraction of the amorphous phases in the composite phases 20 is preferably 5% to 35%, more preferably 5% to 25%. In particular, the area fraction is more preferably 10% or more, further preferably 15% or more. This is because an area fraction of the amorphous phases of 5% or more further increases the ultimate tensile strength. On the other hand, a copper alloy wire containing 35% or more of amorphous phases is difficult to produce. As shown in FIG. 3, amorphous phases 25 are mainly formed at the interfaces between the copper-zirconium compound phases 22 and the copper phases 21, presumably contributing to maintaining sufficient ultimate tensile strength. The area fraction of the amorphous phases can be determined as follows. First, a wire thinned by argon ion milling is prepared as a sample for STEM observation. Next, a region where eutectic phases can be recognized in the central region, serving as a representative region, is observed at a magnification of 500,000 times or more, for example, 500,000 or 2,500,000 times, and lattice images are acquired, for example, in three fields of view of 300 nm×300 nm for a magnification of 500,000 times or in ten fields of view of 50 nm×50 nm for a magnification of 2,500,000 times. Then, the area fractions of possible amorphous regions where atoms are randomly arranged in the acquired STEM lattice images are measured, and the average thereof is calculated as the area fraction of the amorphous phases (hereinafter also referred to as "amorphous fraction").

The composite phases preferably occupy 40% to 60%, more preferably 45% to 60%, and further preferably 50% to 60%, of the copper alloy wire 10 of the present invention in terms of area fraction as observed in a cross-section perpendicular to the axial direction. This is because an area fraction of 40% or more further increases the strength, whereas an area fraction of 60% or less, at which the amount of composite phases is not excessive, prevents a possible break originating from the hard copper-zirconium compound during wire drawing. The area fraction of the composite phases presumably does not exceed 60% within the composition range of the present invention. In addition, if the copper alloy wire is used as a conductive wire, the area fraction of the composite phases 20 is preferably 40% to 50%. This is because an area fraction of the composite phases of 40% to 50% further increases the electrical conductivity, where presumably the copper matrix phases 30 serve as a free electron conductor to maintain sufficient electrical conductivity, whereas the composite phases 20, containing the copper-zirconium compound, maintain sufficient mechanical strength. As used herein, the term "electrical conductivity" refers to the electrical conductivity represented as a proportion relative to the electrical conductivity of annealed pure copper, which is defined as 100%, and is expressed in % IACS (the same applied hereinafter). The area fraction of the composite phases 20 can be determined as follows. First, a drawn copper alloy wire is observed by SEM in a circular cross-section perpendicular to the axial direction. Next, the black-and-white contrast of composite phases (white regions) and copper matrix phases (black regions) is binarized to determine the fraction of the composite phases in the entire cross-section. The resultant value is used as the area fraction of the composite phases (hereinafter also referred to as "composite phase fraction").

Figure 4:
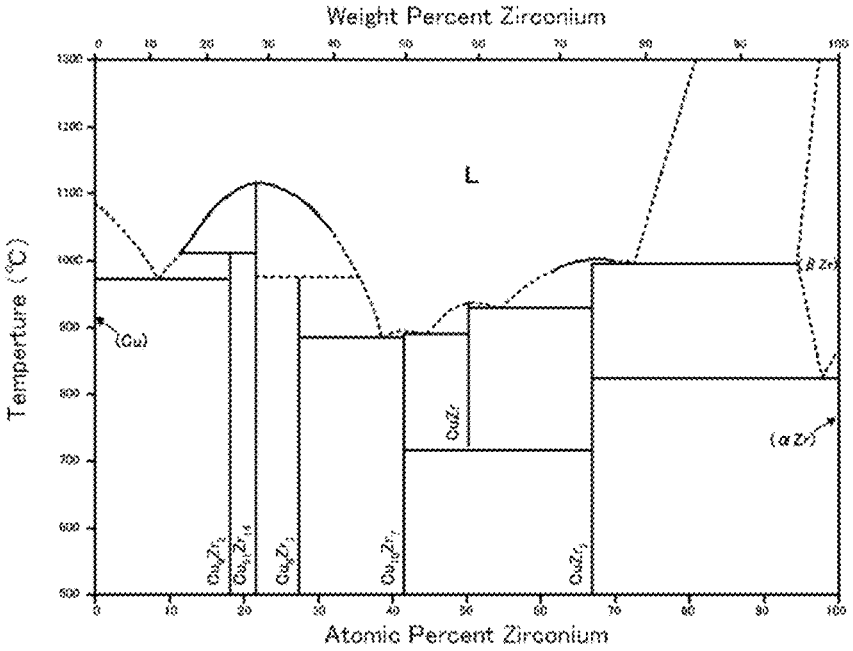
FIG. 4 is an equilibrium diagram of copper-zirconium binary alloy.

The zirconium content of the alloy composition of the copper alloy wire 10 of the present invention is 3.0 to 7.0 atomic percent. Although the balance may include elements other than copper, the balance is preferably copper and incidental impurities, and the amount of incidental impurities is preferably as small as possible. Specifically, the copper alloy is preferably a copper-zirconium binary alloy represented by the composition formula $Cu_{100-x}Zr_x$, wherein x is 3.0 to 7.0. The zirconium content may be 3.0 to 7.0 atomic percent, preferably 4.0 to 6.8 atomic percent, more preferably 5.0 to 6.8 atomic percent. FIG. 4 is an equilibrium diagram of copper-zirconium binary alloy. According to this diagram, presumably the composition of the copper alloy wire of the present invention is a hypoeutectic composition of copper and $Cu_9Zr_2$, and the composite phases 20 are eutectic phases of copper and $Cu_9Zr_2$. A zirconium content of 3.0 atomic percent or more further increases the ultimate tensile strength because the amount of eutectic phases is not too small. On the other hand, a zirconium content of 7.0 atomic percent or less prevents, for example, a possible break originating from hard $Cu_9Zr_2$ during wire drawing because the amount of eutectic phases is not too large. In particular, a binary alloy composition represented by the composition formula $Cu_{100-x}Zr_x$ is preferred in that an appropriate amount of eutectic phases can be more easily formed. In addition, a binary alloy composition is preferred in that it facilitates management for reuse of scrap materials, other than products, produced during manufacture and scrap parts scrapped after their useful lives, as remelted materials.

The copper alloy wire 10 of the present invention has an ultimate tensile strength in the axial direction of 1,300 MPa or more and an electrical conductivity of 20% IACS or more. In addition, the ultimate tensile strength can be increased to 1,500 MPa or more, or to 1,700 MPa or more, depending on the alloy composition and the structure control. For example, a higher ultimate tensile strength can be achieved by increasing the zirconium content (atomic percent), increasing the eutectic phase fraction, reducing the phase pitch, or increasing the amorphous fraction. The reason for such a high ultimate tensile strength is presumably that the double fibrous structure, namely, the matrix phase-composite phase fibrous structure and the composite phase inner fibrous structure, makes the copper alloy wire 10 densely fibrous to provide a strengthening mechanism similar to the rule of mixture for fiber-reinforced composite materials.

The copper alloy wire 10 of the present invention preferably has a diameter of 0.100 mm or less. In particular, the diameter is more preferably 0.040 mm or less, further preferably 0.010 mm or less. The present invention is highly significant to apply to such extremely thin wires because they often result in low production yield due to, for example, a break during wire drawing or stranding because of their insufficient ultimate tensile strength as elemental wires. On the other hand, the diameter is preferably larger than 0.003 mm, and in view of facilitating working, more preferably 0.005 mm or more, further preferably 0.008 mm or more.

The copper alloy wire 10 of the present invention has the following applications. For example, the copper alloy wire 10 increases the density of stator windings of a stepping motor, thus enabling the development of a high-performance motor component that produces high torque despite its compactness. In addition, the copper alloy wire 10 reduces the diameters of outer shield wires and central conductor stranded wires of a coaxial cable to increase the number of inner cores while reducing the outer diameter of the cable. This contributes to a higher performance in electronic devices and medical devices. The copper alloy wire 10 can also be applied to a high-performance flexible flat cable (FFC) that is thinner and more resistant to break. When used as an electrode wire for wire electrical discharge machining, the copper alloy wire 10 minimizes the machining allowance, thus enabling machining with high dimensional accuracy. Furthermore, when used as an antenna wire or a radio-frequency shield wire installed in a portable electronic device, the copper alloy wire 10 reduces constraints on the installation site to broaden the flexibility of radio-frequency circuit design, and even reduces constraints on the shapes and installation sites of parts. In another application, the copper alloy wire 10 provides an ultrathin coil for potential use in a non-contact charging module in a compact electronic device and also improves the charging performance thereof because it increases the winding density per unit volume.

Figure 5:
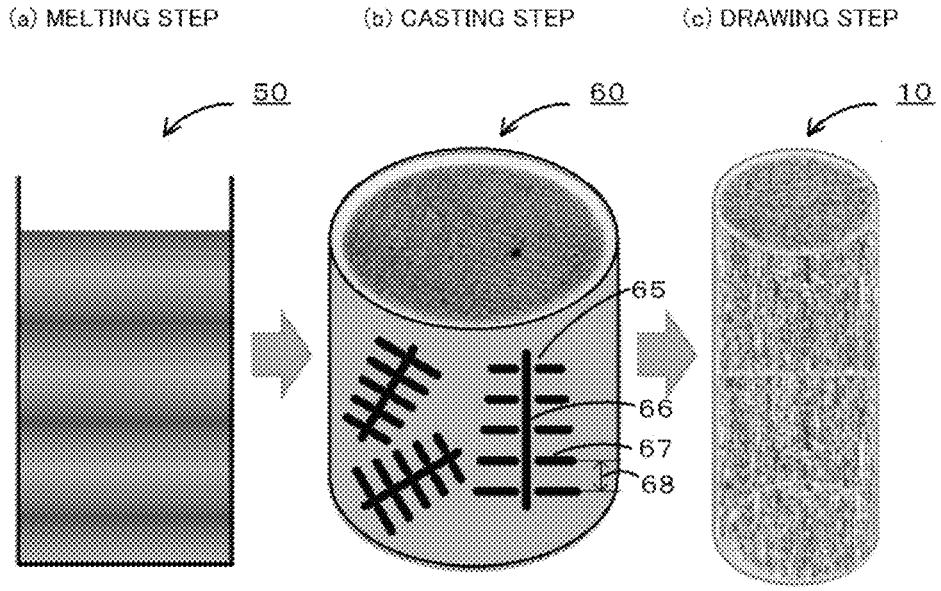
FIG. 5 is an illustration schematically showing a copper alloy in individual steps of the method for producing the copper alloy wire of the present invention.

Next, a method for producing the copper alloy wire 10 will be described. The method for producing the copper alloy wire of the present invention may include (1) a melting step of melting a raw material, (2) a casting step of casting the melt into an ingot, and (3) a wire drawing step of cold-drawing the ingot. The individual steps will now be sequentially described. FIG. 5 is an illustration schematically showing a copper alloy in the individual steps of the method for producing the copper alloy wire of the present invention. FIG. 5(*a*) is an illustration showing a melt 50 melted in the melting step, FIG. 5(*b*) is an illustration showing an ingot 60 formed in the casting step, and FIG. 5(*c*) is an illustration showing the copper alloy wire 10 formed in the wire drawing step.

(1) Melting Step

In the melting step, as shown in FIG. 5(*a*), a process for preparing the melt 50 by melting the raw material is carried out. The raw material used may be any material from which a copper alloy containing 3.0 to 7.0 atomic percent of zirconium can be prepared and may be either an alloy or a pure metal. A copper alloy containing 3.0 to 7.0 atomic percent of zirconium is suitable for cold working. In addition, this copper alloy is preferred in that it has good melt flow because it has low melt viscosity due to its alloy composition close to the eutectic composition. Preferably, the raw material contains no element other than copper and zirconium. In this case, an appropriate amount of eutectic phases can be more readily formed. The melting process may be, for example, but not limited to, a common process such as high-frequency induction melting, low-frequency induction melting, arc melting, or electron beam melting, or may be levitation melting. Of these, high-frequency induction melting and levitation melting are preferably used. High-frequency induction melting is preferred in that it allows melting in high volume at one time, whereas levitation melting, in which molten metal is levitated during melting, is preferred in that it more effectively inhibits molten metal from being contaminated with impurities from, for example, crucibles. The melting atmosphere is preferably a vacuum atmosphere or an inert atmosphere. The inert atmosphere may be any gas atmosphere that does not affect the alloy composition, for example, a nitrogen atmosphere, a helium atmosphere, or an argon atmosphere. Of these, an argon atmosphere is preferably used.

(2) Casting Step

In this step, a process for casting the melt 50 by pouring it into a mold is carried out. As shown in FIG. 5(*b*), the ingot 60 has a dendritic structure including a plurality of dendrites 65. The dendrites 65 are formed only of proeutectic copper phases and each include a primary dendrite arm 66 serving as a trunk and a plurality of secondary dendrite arms 67 serving as branches extending from the primary dendrite arm 66. The secondary dendrite arms 67 extend from the primary dendrite arm 66 substantially perpendicularly.

In this step, the melt 50 is cast into an ingot having a secondary dendrite arm spacing (secondary DAS) of 10.0 μm or less. The secondary DAS may be 10.0 μm or less, preferably 9.4 μm or less, more preferably 4.1 μm or less. If the secondary DAS is 10.0 μm or less, the copper matrix phases 30 and the composite phases 20 form a dense fibrous structure extending in one direction in the subsequent wire drawing step, thus further increasing the ultimate tensile strength. On the other hand, the secondary DAS is preferably larger than 1.0 μm, more preferably 1.6 μm or more, in view of ingot casting. The secondary DAS can be determined as follows. First, three dendrites 65 having a series of four or more secondary dendrite arms 67 are selected in a cross-section of the ingot 60 perpendicular to the axial direction. Next, each spacing 68 between the series of four secondary dendrite arms 67 of each dendrite 65 is measured. Then, the average of a total of nine spacings 68 is calculated as the secondary DAS.

The casting process may be, for example, but not limited to, permanent mold casting or low-pressure casting, or may be a die casting process such as normal die casting, squeeze casting, or vacuum die casting. Continuous casting can also be employed. The mold used for casting is preferably one having high thermal conductivity, for example, a copper mold. The use of a copper mold, which has high thermal conductivity, accelerates the cooling rate during casting, thus further reducing the secondary DAS. The copper mold used is preferably a pure copper mold, although it may be any copper mold having a thermal conductivity similar to that of a pure copper mold (for example, about 350 to 450 W/(m·K) at 25° C.). Although the structure of the mold is not particularly limited, a water-cooled pipe may be installed inside the mold to adjust the cooling rate. The shape of the resultant ingot 60 is preferably, but not limited to, an elongated bar shape. This accelerates the cooling rate. In particular, a round bar shape is preferred. This is because a more uniform casting structure can be achieved. Whereas the casting process for forming the ingot 60 has been described above, it is particularly suitable to form a bar-shaped ingot having a diameter of 3 to 10 mm by casting using a copper mold. This is because a diameter of 3 mm or more allows a better melt flow, whereas a diameter of 10 mm or less further reduces the secondary DAS. The pouring temperature is preferably 1,100° C. to 1,300° C., more preferably 1,150° C. to 1,250° C. This is because a pouring temperature of 1,100° C. or more allows a good melt flow, whereas a pouring temperature of 1,300° C. or less causes little deterioration of the mold.

(3) Wire Drawing Step

In this step, a process for forming the copper alloy wire 10 shown in FIGS. 5(*c*) and 1 by drawing the ingot 60 is carried out. In this step, the ingot 60 is cold-drawn to a reduction of area of 99.00% or more. As used herein, the term "cold" refers to working at room temperature without heating. Thus, cold wire drawing presumably inhibits recrystallization, thus making it possible to easily provide a copper alloy wire 10 densely fibrous with the double fibrous structure, namely, the matrix phase-composite phase fibrous structure and the composite phase inner fibrous structure. In addition, cold wire drawing simplifies the production process for increased productivity because the copper alloy wire 10 can be produced only by cold wire drawing without the need for annealing during the working of the ingot 60 into the copper alloy wire 10 or aging after the working. The wire drawing process may be, for example, but not limited to, hole die drawing or roller die drawing, more preferably a wire drawing process by which a shear force is applied in a direction parallel to the axis so that the material undergoes shear slip deformation. Such wire drawing is also herein referred to as "shear wire drawing." The shear slip deformation, as caused by shear wire drawing, presumably makes the fibrous structure more uniform, thus further increasing the ultimate tensile strength. The shear slip deformation may be, for example, simple shear deformation applied by drawing the material through a die while causing friction at the surface in contact with the die. The wire drawing step may be carried out by drawing the ingot 60 to a reduction of area of 99.00% or more through a plurality of dies of different sizes. In this case, a break is less likely to occur during the wire drawing. The hole of the drawing die does not have to be circular; instead, a die for square wires, a die for wires of special shape, or a die for tubes may be used. The reduction of area may be 99.00% or more, preferably 99.50% or more, more preferably 99.80% or more. This is because a higher reduction of area further increases the ultimate tensile strength. Although the reason for this remains uncertain, the ultimate tensile strength increases with increasing drawing ratio presumably because the crystal structure is distorted as the composite phases 20 change their crystal structure to occupy a larger area as viewed in cross-section, or as the copper matrix phases 30 deform preferentially to occupy a smaller area as viewed in cross-section. Another possible cause is that copper and $Cu_9Zr_2$, which are thought to form an fcc structure and a superlattice, respectively, become partially amorphous after heavy working. The present inventors have carried out wire drawing of ingots produced under the same conditions at varying reductions of area (drawing ratios) and have demonstrated that the volume of the composite phases 20 increases with increasing reduction rate. The reduction of area may be less than 100.00% and is preferably 99.9999% or less in view of working. The reduction of area can be determined as follows. First, the cross-sectional area of the ingot 60 before the wire drawing in a cross-section perpendicular to the axial direction is determined. After the wire drawing, the cross-sectional area of the copper alloy wire 10 in a cross-section perpendicular to the axial direction is determined. The reduction of area (%) is then determined by calculating {(cross-sectional area before wire drawing−cross-sectional area after wire drawing)×100}/(cross-sectional area before wire drawing). The drawing speed is preferably, but not limited to, 10 to 200 m/min, more preferably 20 to 100 m/min. This is because a drawing speed of 10 m/min or more allows efficient wire drawing, whereas a drawing speed of 200 m/min or less more reliably prevents, for example, a break during the wire drawing.

In the wire drawing step, the ingot 60 is preferably drawn to a diameter of 0.100 mm or less, more preferably 0.040 mm or less, and further preferably 0.010 mm or less. The present invention is highly significant to apply to such extremely thin wires because they often result in low production yield due to, for example, a break during wire drawing or stranding because of their insufficient ultimate tensile strength as elemental wires. On the other hand, the diameter is preferably larger than 0.003 mm, and in view of facilitating working, more preferably 0.005 mm or more, further preferably 0.008 mm or more.

In this wire drawing step, the copper alloy wire 10 is formed. This copper alloy wire 10 includes the composite phases 20 composed of the copper-zirconium compound phases 22 and the copper phases 21 and the copper matrix phases 30. As shown in FIG. 2, the copper matrix phases 30 and the composite phases 20 form a matrix phase-composite phase fibrous structure and are arranged alternately parallel to the axial direction as viewed in a cross-section parallel to the axial direction and including the central axis. In the composite phases 20, additionally, the copper-zirconium compound phases 22 and the copper phases 21 form a composite phase inner fibrous structure and are arranged alternately parallel to the axial direction at a phase pitch of 50 nm or less as viewed in a cross-section parallel to the axial direction and including the central axis. Thus, presumably the double fibrous structure, namely, the matrix phase-composite phase fibrous structure and the composite phase inner fibrous structure, makes the copper alloy wire 10 densely fibrous to provide a strengthening mechanism similar to the rule of mixture for fiber-reinforced composite materials.

The present invention is not limited to the embodiment described above; it can be practiced in various manners within the technical scope thereof.

For example, in the embodiment described above, the copper alloy wire 10 has the matrix phase-composite phase fibrous structure and the composite phase inner fibrous structure and, in the composite phase inner fibrous structure, the copper-zirconium compound phases and the copper phases are arranged alternately parallel to the axial direction at a phase pitch of 50 nm or less as viewed in a cross-section parallel to the axial direction and including the central axis; instead, the copper alloy wire 10 may include copper matrix phases and composite phases composed of copper-zirconium compound phases and copper phases, the zirconium content of the alloy composition may be 3.0 to 7.0 atomic percent, and the composite phases may contain 5% to 25% of amorphous phases in terms of area fraction as viewed in a cross-section parallel to the axial direction and including the central axis. This is because an area fraction of amorphous phases of 5% to 25% provides high ultimate tensile strength. More preferably, in the above composite phases, the copper-zirconium compound phases and the copper phases form a composite phase inner fibrous structure and are arranged alternately parallel to the axial direction as viewed in a cross-section parallel to the axial direction and including the central axis. This further increases the ultimate tensile strength.

Whereas the method for producing the copper alloy wire 10 according to the embodiment described above includes the casting step of casting the melt 50 into an ingot having a secondary DAS of 10.0 μm or less, it may instead include a casting step of casting the melt 50 into a bar-shaped ingot having a diameter of 3 to 10 mm using a copper mold. This provides a copper alloy wire 10 having high ultimate tensile strength.

Whereas the method for producing the copper alloy wire 10 according to the embodiment described above includes the melting step, the casting step, and the wire drawing step, it may include other steps. For example, a holding step, that is, a step of holding the melt, may be included between the melting step and the casting step. If the holding step is included, melting can be started in the melting furnace immediately after transferring the melt to a holding furnace without waiting for all the melt melted in the melting step to be completely cast, thus further increasing the utilization of the melting furnace. In addition, if component adjustment is performed in the holding step, finer adjustment can be more readily performed. In addition, a cooling step of cooling the ingot may be included between the casting step and the wire drawing step. This reduces the time from casting to wire drawing.

Whereas the melting, casting, and wire drawing steps of the method for producing the copper alloy wire 10 according to the embodiment described above are described as separate steps, the individual steps may be continuous without clear boundaries therebetween, as in continuous casting and wire drawing, which is employed as an integrated process of producing, for example, copper wires. This allows more efficient production of the copper alloy wire 10.

The above description of the copper alloy wire and the method for producing the copper alloy wire of the present invention is directed to alloy compositions containing 3.0 to 7.0 atomic percent of zirconium, with the balance being copper, and containing as small amounts of other elements as possible (hereinafter also referred to as "other-element-free materials"). As a result of a further study, the present inventors have found that alloy compositions containing components other than copper and zirconium (hereinafter also referred to as "other-element-containing materials") provide higher strength. Preferred embodiments of other-element-containing materials will now be described. Because the basic composition and method for production are common to other-element-free materials and other-element-containing materials, the above description of other-element-free materials applies to other-element-containing materials for common details; therefore, a description thereof will be omitted.

In the copper alloy wire of the present invention, the copper matrix phases may be further divided into a plurality of copper phases in fibrous form (hereinafter also referred to as "layered" because they are layered as observed in a cross-section). That is, the copper matrix phases 30 may be composed of a plurality of copper phases forming a copper matrix phase inner fibrous structure and arranged alternately parallel to the axial direction as viewed in a cross-section parallel to the axial direction and including the central axis. In this case, the average width of the plurality of copper phases is preferably 150 nm or less, more preferably 100 nm or less, and further preferably 50 nm or less. Thus, if a copper matrix phase inner fibrous structure is formed in the copper matrix phases 30, presumably the ultimate tensile strength can be further increased by the effect similar to the Hall-Petch law, which states that the ultimate tensile strength increases as the grain size becomes smaller. At the same time, the copper matrix phases preferably contain deformation twins. Thus, if the copper matrix phases contain deformation twins, presumably the ultimate tensile strength can be increased as a result of twinning without significantly decreasing the electrical conductivity. The deformation twins are preferably present at an angle of 20° to 40° with reference to the axial direction so as not to straddle the boundaries between the adjacent copper phases as viewed in a cross-section parallel to the axial direction and including the central axis. In addition, the copper matrix phases preferably contain 0.1% to 5% of deformation twins. In addition, it is preferable that almost no dislocations be found in the α-copper phases and the copper-zirconium compound phases, at least in a longitudinal cross-section. In particular, presumably the electrical conductivity can be further increased if the α-copper phases, which are good conductors, have fewer dislocations. For other-element-free materials, the copper matrix phases may be divided into a plurality of copper phases, may contain deformation twins, and may have fewer dislocations. In such cases, presumably the ultimate tensile strength or the electrical conductivity can be further increased.

In the copper alloy wire of the present invention, the average width of the copper-zirconium compound phases as viewed in a cross-section parallel to the axial direction and including the central axis is preferably 20 nm or less, more preferably 10 nm or less, further preferably 9 nm or less, and most preferably 7 nm or less. If the average width is 20 nm or less, presumably the ultimate tensile strength can be further increased. In addition, the copper-zirconium compound phases are preferably represented by the general formula $Cu_9Zr_2$ and are more preferably amorphous phases in part or the entirety thereof. This is because presumably amorphous phases are readily formed in the $Cu_9Zr_2$ phases. For other-element-free materials, presumably the ultimate tensile strength can be further increased if the average width of the copper-zirconium compound phases is 20 nm or less. For other-element-free materials, additionally, the $Cu_9Zr_2$ phases may be amorphous phases in part or the entirety thereof.

The copper alloy wire of the present invention may contain elements other than copper and zirconium. For example, the copper alloy wire may contain elements such as oxygen, silicon, and aluminum. In particular, the copper alloy wire preferably contains oxygen because it makes the copper alloy, particularly the $Cu_9Zr_2$ phases, more amorphous for the unknown reason. In particular, the copper alloy becomes more amorphous with increasing drawing ratio. The amount of oxygen in the raw material composition is preferably, but not limited to, 700 to 2,000 ppm by mass. In addition, oxygen is preferably contained in the copper alloy wire, particularly, in the copper-zirconium compound phases. Similarly, if silicon and aluminum are contained, they are preferably contained in the copper-zirconium compound. In this case, the mean atomic number Z of the copper-zirconium compound phases calculated from the elemental composition determined by quantitative measurement of the O—K line, the Si—K line, the Cu—K line, and the Zr-L line using the ZAF method based on EDX analysis is preferably 20 to less than 29. More preferably, the mean atomic number $Z_A$ of the copper-zirconium compound phases calculated from the elemental composition determined by quantitative measurement of the O—K line, the Si—K line, the Al—K line, the Cu—K line, and the Zr-L line using the ZAF method based on EDX analysis is 20 to less than 29. If the mean atomic number Z is 20 or more, presumably the amounts of oxygen and silicon are not excessive, so that the ultimate tensile strength and the electrical conductivity can be further increased. On the other hand, if the mean atomic number Z is less than 29, that is, less than the atomic number of copper, presumably the proportion of oxygen and silicon and the proportion of copper and zirconium are well-balanced, so that the ultimate tensile strength and the electrical conductivity can be increased. In addition, the proportion of zirconium in the copper alloy wire is preferably 3.0 to 6.0 atomic percent. At the same time, the copper matrix phases preferably contain no oxygen. As used herein, the phrase "contain no oxygen" refers to, for example, containing an amount of oxygen that is undetectable in the above quantitative measurement using the ZAF method based on EDX analysis. The mean atomic number Z can be determined as the sum of the atomic number of oxygen, 8, the atomic number of silicon, 14, the atomic number of copper, 29, and the atomic number of zirconium, 40, multiplied by the respective elemental concentrations (in atomic percent) and divided by 100.

The copper alloy wire of the present invention has an ultimate tensile strength in the axial direction of 1,300 MPa or more and an electrical conductivity of 15% IACS or more. Furthermore, the ultimate tensile strength can be increased to, for example, 1,500 MPa or more, 1,700 MPa or more, or 2,200 MPa or more, depending on the alloy composition and the structure control. In addition, the electrical conductivity in the axial direction can be increased to, for example, 16% IACS or more, or 20% IACS or more, depending on the alloy composition and the structure control. In addition, the Young's modulus in the axial direction can be varied depending on the alloy composition and the structure control. For example, the Young's modulus in the axial direction can be characteristically decreased to 60 to 90 GPa, which is nearly half those of typical copper alloys as disclosed in PTLs 1 and 2. For other-element-free materials, presumably the Young's modulus can be decreased to, for example, 110 to 140 GPa by controlling, for example, the proportion of the amorphous phases.

Next, the production method will be described. In the method for producing the copper alloy wire of the present invention, the raw material used in the melting step may be a material containing at least oxygen in addition to copper and zirconium. The amount of oxygen is preferably 700 to 2,000 ppm by mass, more preferably 800 to 1,500 ppm by mass. A material containing oxygen is preferred because it makes the copper alloy, particularly the $Cu_9Zr_2$ phases, more amorphous for the unknown reason. The vessel used for melting the raw material is preferably a crucible. In addition, the vessel used for melting the raw material is preferably, but not limited to, a vessel containing silicon or aluminum, more preferably a vessel containing quartz ($SiO_2$) or alumina ($Al_2O_3$). For example, a quartz or alumina vessel can be used. Of these, if a quartz vessel is used, silicon may intrude into the alloy and, particularly, intrudes easily into the composite phases, more particularly the $Cu_9Zr_2$ phases. The vessel preferably has a tap hole in the bottom surface thereof. This allows the melt to be poured through the tap hole in the subsequent casting step while continuing injection of an inert gas, thus more readily allowing oxygen to remain in the alloy. In addition, the melting atmosphere is preferably an inert gas atmosphere, and particularly, the raw material is preferably melted while injecting an inert gas so as to apply pressure to the surface of the alloy. This presumably allows the oxygen contained in the raw material to remain in the alloy, thus making it more amorphous. The pressure of the inert gas is preferably 0.5 to 2.0 MPa.

In the method for producing the copper alloy wire of the present invention, the inert gas atmosphere is preferably maintained in the casting step continuously after the melting step so as to apply pressure to the surface of the alloy. In this case, the inert gas is preferably injected so as to apply a pressure of 0.5 to 2.0 MPa to the raw material. In addition, the melt is preferably poured through the tap hole in the bottom surface of the crucible while injecting the inert gas. This allows the melt to be poured without contact with outside air (atmospheric air). In the casting step, the melt is preferably solidified by quenching so that, according to results of an analysis by the EDX-ZAF method, the amount of zirconium contained in the copper matrix phases of the ingot at room temperature after the solidification is supersaturated at 0.3 atomic percent or more. This is because such solidification by quenching further increases the ultimate tensile strength. In the copper-zirconium equilibrium diagram, the solid solubility limit of zirconium is 0.12%. Although the mold used in the casting step is not particularly limited, the metal melted in the melting step is preferably poured into a copper mold or a carbon die because they allow the melt to be more readily quenched. For production of other-element-free materials, it is presumably preferable to solidify the melt by quenching so that, according to results of an analysis by the EDX-ZAF method, the amount of zirconium is supersaturated at 0.3 atomic percent or more. For production of other-element-free materials, additionally, the metal melted in the melting step may be poured into a copper mold or a carbon die.

In the method for producing the copper alloy wire of the present invention, the ingot is preferably cold-drawn to a reduction of area of 99.00% or more through one or more drawing passes in the wire drawing. Preferably, at least one of the drawing passes has a reduction of area of 15% or more. This presumably further increases the ultimate tensile strength. In the wire drawing step, additionally, the temperature for cold wire drawing is preferably lower than room temperature (for example, 30° C.), more preferably 25° C. or less, and further preferably 20° C. or less. This presumably allows deformation twins to occur more readily, thus further increasing the ultimate tensile strength. The temperature can be controlled by, for example, cooling at least one of the material and the equipment for wire drawing (such as a wire drawing die) to a temperature lower than room temperature before use. Examples of methods for cooling the material or the equipment include immersing the material or the equipment in a bath filled with a liquid and pouring a liquid over the material or the equipment using, for example, a shower. In this case, the liquid used is preferably cooled in advance, and it may be cooled, for example, by allowing a coolant to flow through a cooling pipe provided in the bath filled with the liquid, or by returning a liquid cooled with a coolant into the bath. For example, the liquid is preferably a lubricant. This is because, if the material is cooled with a lubricant, the wire drawing can be more readily performed. On the other hand, if the equipment is cooled, it may be cooled by allowing a coolant to flow through, for example, a pipe provided in the equipment. Examples of coolants for cooling the liquid or the equipment include hydrofluorocarbons, alcohols, liquid ethylene glycol, and dry ice. For production of other-element-free materials, presumably such a wire drawing step may be included.

EXAMPLES

Production of Wire

Example 1

Figure 6:
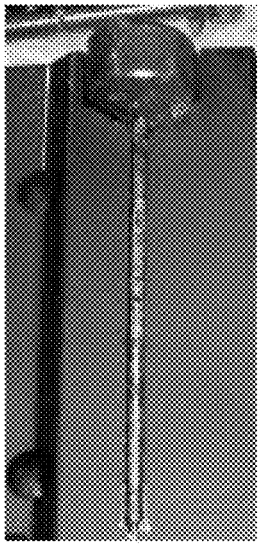
FIG. 6 is a photograph of the round-bar ingot and die.
Figure 7:
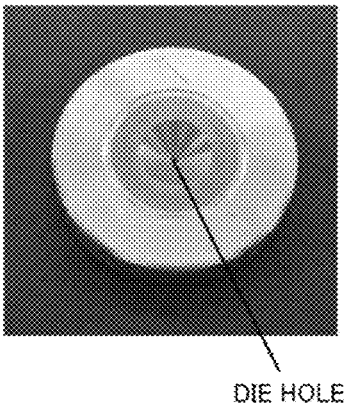
FIG. 7 is a photograph of a diamond die used for drawing.

First, a copper-zirconium binary alloy containing 3.0 atomic percent of zirconium with the balance being copper was subjected to levitation melting in an argon gas atmosphere. Next, a pure copper mold having a round-bar-shaped cavity with a diameter of 3 mm was coated, and the melt of about 1,200° C. was poured and cast into a round-bar ingot at about 1,200° C. The diameter of the ingot was determined to be 3 mm by measurement using a micrometer. FIG. 6 is a photograph of the round-bar ingot. Next, wire drawing was performed by passing the round-bar ingot, which had been cooled to room temperature, through 20 to 40 dies having gradually decreasing hole diameters at room temperature so that the diameter after the wire drawing was 0.300 mm, thus producing a wire of Example 1. During the process, the drawing speed was 20 m/min. The diameter of the copper alloy wire was determined to be 0.300 mm by measurement using a micrometer. FIG. 7 is a photograph of a diamond die used for drawing. The diamond dies had die holes in the centers thereof, and the ingot was sequentially passed through the dies of different hole diameters to perform wire drawing by shearing.

Examples 2 to 4

A wire of Example 2 was produced in the same manner as in Example 1 except that wire drawing was performed so that the diameter after the wire drawing was 0.100 mm. In addition, a wire of Example 3 was produced in the same manner as in Example 1 except that wire drawing was performed so that the diameter after the wire drawing was 0.040 mm. In addition, a wire of Example 4 was produced in the same manner as in Example 1 except that wire drawing was performed so that the diameter after the wire drawing was 0.010 mm.

Examples 5 to 9

A wire of Example 5 was produced in the same manner as in Example 1 except that a copper-zirconium binary alloy containing 4.0 atomic percent of zirconium with the balance being copper was used. In addition, a wire of Example 6 was produced in the same manner as in Example 5 except that wire drawing was performed so that the diameter after the wire drawing was 0.100 mm. In addition, a wire of Example 7 was produced in the same manner as in Example 5 except that wire drawing was performed so that the diameter after the wire drawing was 0.040 mm. In addition, a wire of Example 8 was produced in the same manner as in Example 5 except that wire drawing was performed so that the diameter after the wire drawing was 0.010 mm. In addition, a wire of Example 9 was produced in the same manner as in Example 5 except that wire drawing was performed so that the diameter after the wire drawing was 0.008 mm.

Examples 10 to 13

A wire of Example 10 was produced in the same manner as in Example 5 except that a pure copper mold having a diameter of 5 mm was used and that wire drawing was performed so that the diameter after the wire drawing was 0.100 mm. In addition, a wire of Example 11 was produced in the same manner as in Example 10 except that wire drawing was performed so that the diameter after the wire drawing was 0.040 mm. In addition, a wire of Example 12 was produced in the same manner as in Example 10 except that wire drawing was performed so that the diameter after the wire drawing was 0.010 mm. In addition, a wire of Example 13 was produced in the same manner as in Example 10 except that wire drawing was performed so that the diameter after the wire drawing was 0.008 mm.

Examples 14 to 16

A wire of Example 14 was produced in the same manner as in Example 5 except that a pure copper mold having a diameter of 7 mm was used and that wire drawing was performed so that the diameter after the wire drawing was 0.100 mm. In addition, a wire of Example 1.5 was produced in the same manner as in Example 14 except that wire drawing was performed so that the diameter after the wire drawing was 0.040 mm. In addition, a wire of Example 16 was produced in the same manner as in Example 14 except that wire drawing was performed so that the diameter after the wire drawing was 0.010 mm.

Examples 17 to 19

A wire of Example 17 was produced in the same manner as in Example 5 except that a pure copper mold having a diameter of 10 mm was used and that wire drawing was performed so that the diameter after the wire drawing was 0.100 mm. In addition, a wire of Example 18 was produced in the same manner as in Example 17 except that wire drawing was performed so that the diameter after the wire drawing was 0.040 mm. In addition, a wire of Example 19 was produced in the same manner as in Example 17 except that wire drawing was performed so that the diameter after the wire drawing was 0.010 mm.

Examples 20 to 23

A wire of Example 20 was produced in the same manner as in Example 1 except that a copper-zirconium binary alloy containing 5.0 atomic percent of zirconium with the balance being copper was used. In addition, a wire of Example 21 was produced in the same manner as in Example 20 except that wire drawing was performed so that the diameter after the wire drawing was 0.100 mm. In addition, a wire of Example 22 was produced in the same manner as in Example 20 except that wire drawing was performed so that the diameter after the wire drawing was 0.040 mm. In addition, a wire of Example 23 was produced in the same manner as in Example 23 except that wire drawing was performed so that the diameter after the wire drawing was 0.010 mm.

Examples 24 to 27

A wire of Example 24 was produced in the same manner as in Example 1 except that a copper-zirconium binary alloy containing 6.8 atomic percent of zirconium with the balance being copper was used. In addition, a wire of Example 25 was produced in the same manner as in Example 24 except that wire drawing was performed so that the diameter after the wire drawing was 0.100 mm. In addition, a wire of Example 26 was produced in the same manner as in Example 24 except that wire drawing was performed so that the diameter after the wire drawing was 0.040 mm. In addition, a wire of Example 27 was produced in the same manner as in Example 24 except that wire drawing was performed so that the diameter after the wire drawing was 0.010 mm.

Comparative Example 1

A wire of Comparative Example 1 was produced in the same manner as in Example 1 except that a copper-zirconium binary alloy containing 2.5 atomic percent of zirconium with the balance being copper was used, and that wire drawing was performed so that the diameter after the wire drawing was 0.100 mm.

Comparative Example 2

In Comparative Example 2, wire drawing was performed in the same manner as in Example 1 except that a copper-zirconium binary alloy containing 7.4 atomic percent of zirconium with the balance being copper was used and that wire drawing was performed so that the diameter after the wire drawing was 0.100 mm, although the wire was broken during the wire drawing.

Comparative Example 3

A copper-zirconium binary alloy containing 8.7 atomic percent of zirconium with the balance being copper was subjected to levitation melting and was cast into a round-bar ingot by pouring it into a pure copper mold having a diameter of 7 mm, although the ingot was cracked during the casting and could not be subjected to the subsequent wire drawing step.

Comparative Example 4

A wire of Comparative Example 4 was produced in the same manner as in Example 5 except that a pure copper mold having a diameter of 12 mm was used and that wire drawing was performed so that the diameter after the wire drawing was 0.600 mm.

Comparative Example 5

A wire of Comparative Example 5 was produced in the same manner as in Example 5 except that a pure copper mold having a diameter of 7 mm was used and that wire drawing was performed so that the diameter after the wire drawing was 0.800 mm.

Observation of Casting Structure

Figure 8:
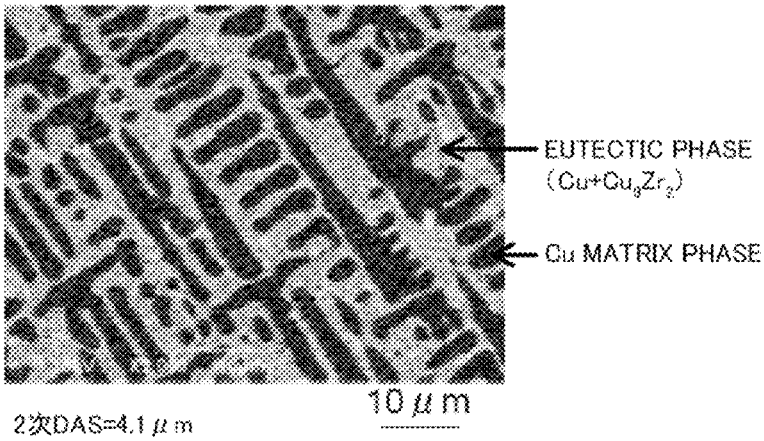
FIG. 8 is an SEM photograph of the casting structure of an ingot containing 4.0 atomic percent of zirconium and having a diameter of 5 mm.

The ingots before the wire drawing were cut in a circular cross-section perpendicular to the axial direction, were mirror-polished, and were observed by SEM (SU-70, manufactured by Hitachi, Ltd.). FIG. 8 is an SEM photograph of the casting structure of an ingot containing 4.0 atomic percent of zirconium and having a diameter of 5 mm. The white regions are eutectic phases of copper and $Cu_9Zr_2$, and the black regions are proeutectic copper matrix phases. The secondary DAS was measured using the SEM photographs. Table 1 shows the values of the secondary DAS of Examples 1 to 27 and Comparative Examples 1 to 5. Table 1 shows the secondary DAS, the alloy composition, casting diameter, and drawing diameter described above, and the reduction of area, eutectic phase fraction, phase pitch, amorphous fraction, ultimate tensile strength, and electrical conductivity described below.

TABLE 1

| | Melting and Casting Steps | | | Wire Drawing Step | | | | | Wire Property | |
|---|---|---|---|---|---|---|---|---|---|---|
| | | | | | | Eutectic[2] | | | Ultimate | |
| | Alloy Composition at % (Zr) | Casting Diameter mm | Secondary[1] DAS μm | Drawing Diameter mm | Reduction of Area % | Phase Fraction % | Phase[3] Pitch nm | Amorphous[4] Fraction % | Tensile Strength MPa | Electrical[5] Conductivity % IACS |
| Example 1 | 3.0 | 3 | 3.2 | 0.300 | 99.0000 | 40 | 50 | 6 | 1320 | 44 |
| Example 2 | 3.0 | 3 | 3.2 | 0.100 | 99.8889 | 43 | 50 | 7 | 1350 | 40 |
| Example 3 | 3.0 | 3 | 3.2 | 0.040 | 99.9822 | 44 | 50 | 7 | 1380 | 38 |
| Example 4 | 3.0 | 3 | 3.2 | 0.010 | 99.9989 | 44 | 50 | 9 | 1420 | 33 |
| Example 5 | 4.0 | 3 | 1.9 | 0.300 | 99.0000 | 46 | 40 | 5 | 1300 | 40 |
| Example 6 | 4.0 | 3 | 1.9 | 0.100 | 99.8889 | 49 | 20 | 11 | 1510 | 36 |
| Example 7 | 4.0 | 3 | 1.9 | 0.040 | 99.9822 | 49 | 20 | 10 | 1620 | 37 |
| Example 8 | 4.0 | 3 | 1.9 | 0.010 | 99.9989 | 48 | 30 | 12 | 1700 | 33 |
| Example 9 | 4.0 | 3 | 1.9 | 0.008 | 99.9993 | 50 | 20 | 13 | 1720 | 29 |
| Example 10 | 4.0 | 5 | 4.1 | 0.100 | 99.9600 | 49 | 40 | 15 | 1800 | 27 |
| Example 11 | 4.0 | 5 | 4.1 | 0.040 | 99.9936 | 50 | 40 | 22 | 1820 | 25 |
| Example 12 | 4.0 | 5 | 4.1 | 0.010 | 99.9996 | 50 | 30 | 24 | 1840 | 24 |
| Example 13 | 4.0 | 5 | 4.1 | 0.008 | 99.9997 | 51 | 20 | 24 | 1850 | 24 |
| Example 14 | 4.0 | 7 | 6.1 | 0.100 | 99.9796 | 47 | 50 | 17 | 1650 | 36 |
| Example 15 | 4.0 | 7 | 6.1 | 0.040 | 99.9967 | 48 | 50 | 18 | 1720 | 33 |
| Example 16 | 4.0 | 7 | 6.1 | 0.010 | 99.9998 | 48 | 40 | 18 | 1750 | 29 |
| Example 17 | 4.0 | 10 | 9.4 | 0.100 | 99.9900 | 44 | 50 | 10 | 1350 | 38 |
| Example 18 | 4.0 | 10 | 9.4 | 0.040 | 99.9984 | 45 | 40 | 10 | 1400 | 37 |
| Example 19 | 4.0 | 10 | 9.4 | 0.010 | 99.9999 | 47 | 40 | 12 | 1420 | 37 |
| Example 20 | 5.0 | 3 | 1.7 | 0.300 | 99.0000 | 54 | 50 | 15 | 1550 | 36 |
| Example 21 | 5.0 | 3 | 1.7 | 0.100 | 99.8889 | 55 | 30 | 23 | 1810 | 26 |
| Example 22 | 5.0 | 3 | 1.7 | 0.040 | 99.9822 | 56 | 20 | 23 | 1850 | 24 |
| Example 23 | 5.0 | 3 | 1.7 | 0.010 | 99.9989 | 57 | 20 | 25 | 1870 | 22 |
| Example 24 | 6.8 | 3 | 1.6 | 0.300 | 99.0000 | 53 | 30 | 15 | 1570 | 35 |
| Example 25 | 6.8 | 3 | 1.6 | 0.100 | 99.8889 | 55 | 20 | 22 | 1820 | 24 |
| Example 26 | 6.8 | 3 | 1.6 | 0.040 | 99.9822 | 57 | 20 | 24 | 1850 | 21 |
| Example 27 | 6.8 | 3 | 1.6 | 0.010 | 99.9989 | 60 | 20 | 25 | 1880 | 21 |
| Comparative Example 1 | 2.5 | 3 | 4.2 | 0.100 | 99.8889 | 32 | 120 | 3 | 1120 | 45 |
| Comparative Example 2 | 7.4 | 3 | 1.6 | 0.100 | Break | — | — | — | — | — |
| Comparative Example 3 | 8.7 | 7 | Crack | — | — | — | — | — | — | — |
| Comparative Example 4 | 4.0 | 12 | 10.8 | 0.600 | 99.7500 | 33 | 80 | 4 | 1240 | 41 |
| Comparative Example 5 | 4.0 | 7 | 6.1 | 0.800 | 99.6939 | 38 | 70 | 4 | 1280 | 33 |

[1]Secondary dendrite arm spacing
[2]Area fraction of eutectic phase as viewed in a cross-section perpendicular to the axial direction
[3]Average of widths of Cu phases and $Cu_9Zr_2$ phases in eutectic phase as viewed in a cross-section parallel to the axial direction and including a central axis
[4]Area fraction of amorphous region in eutectic phase as viewed in a cross-section parallel to the axial direction and including a central axis
[5]Proportion relative to electrical conductivity of annealed pure copper, which is defined as 100%

Derivation of Reduction of Area

First, the cross-sectional area of each ingot before the wire drawing was determined from the diameter thereof, and the cross-sectional area after the wire drawing was determined from the diameter of the copper alloy wire. From these values, the cross-sectional areas before and after the wire drawing and the reduction of area were determined. The reduction of area (%) is the value represented by {(cross-sectional area before wire drawing−cross-sectional area after wire drawing)×100}/(cross-sectional area before wire drawing).

Observation of Structure after Wire Drawing

Figure 9:
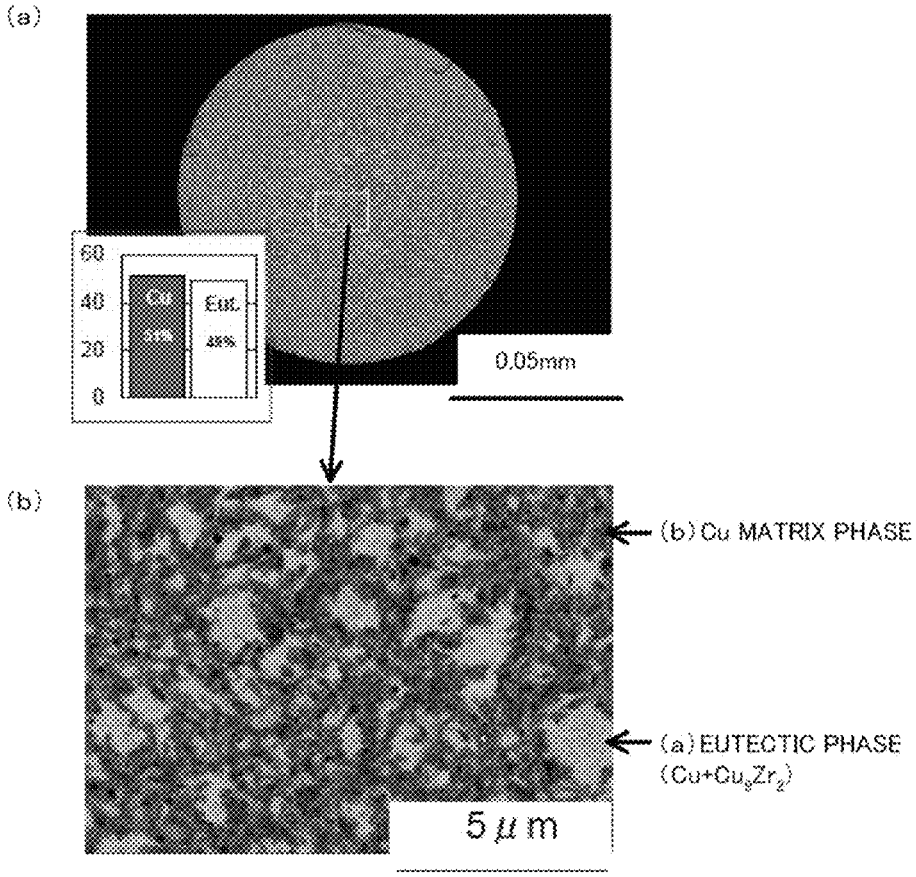
FIG. 9 is a set of SEM photographs of the copper alloy wire of Example 6 in a cross-section perpendicular to the axial direction.
Figure 10:
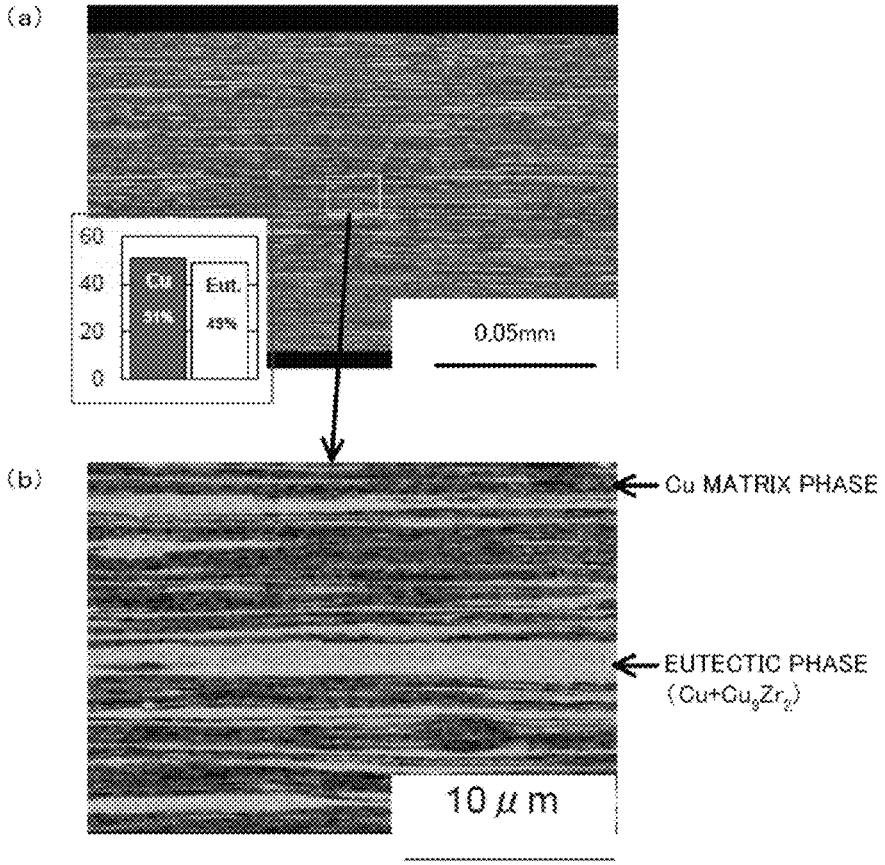
FIG. 10 is a set of SEM photographs of the copper alloy wire of Example 6 in a cross-section parallel to the axial direction and including the central axis.
Figure 11:
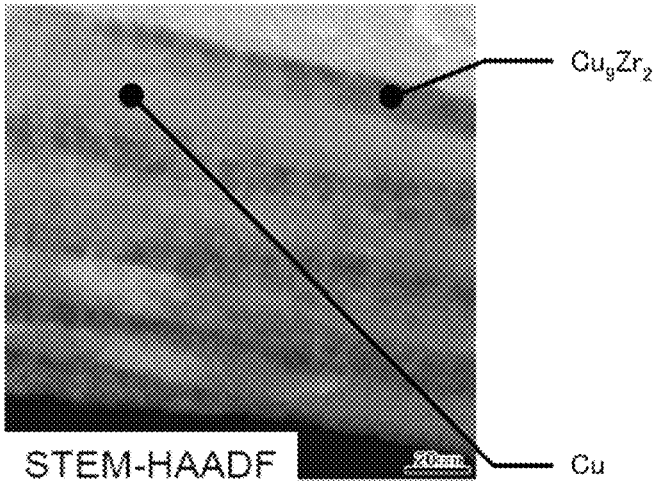
FIG. 11 is an STEM photograph of a eutectic phase of Example 6.
Figure 12:
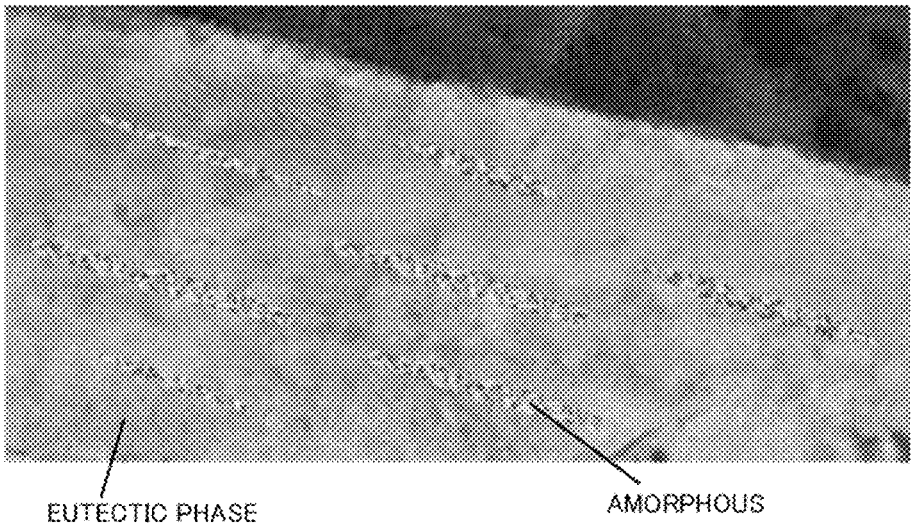
FIG. 12 schematically shows the amorphous phases in the eutectic phase.

The copper alloy wires after the wire drawing were cut in a circular cross-section perpendicular to the axial direction, were mirror-polished, and were observed by SEM. FIG. 9 is a set of SEM photographs of the copper alloy wire of Example 6 in a circular cross-section perpendicular to the axial direction. FIG. 9(*b*) is a magnified view of the region enclosed by the rectangle in the center of FIG. 9(*a*). The white regions are eutectic phases, and the black regions are copper matrix phases. The black-and-white contrast of the SEM photograph was divided into the copper matrix phases and the eutectic phases by binarization, and the area fraction of the eutectic phases was determined as the eutectic phase fraction. FIG. 10 is a set of SEM photographs of the copper alloy wire of Example 6 in a cross-section parallel to the axial direction and including the central axis. FIG. 10(*b*) is a magnified view of the region enclosed by the rectangle in the center of FIG. 10(*a*). The white regions are eutectic phases, and the black regions are copper matrix phases; they were arranged in a staggered manner to form a fibrous structure extending in one direction. In this regard, an analysis of the field of view in FIG. 10 by energy dispersive X-ray spectroscopy (EDX) revealed that the black regions were matrix phases formed only of copper and the white regions were eutectic phases containing copper and zirconium. Next, the phase pitch of copper and $Cu_9Zr_2$ was measured by STEM as follows. First, a wire thinned by argon ion milling was prepared as a sample for STEM observation. Then, the central region, serving as a representative region, was observed at a magnification of 500,000 times, and scanning electron microscopy high-angle annular dark-field images (STEM-HAADF images) were acquired in three fields of view of 300 nm×300 nm. The widths of the phases in the STEM-HAADF images were measured, and the average thereof was calculated as the measured phase pitch. FIG. 11 is an STEM photograph, taken by STEM (JEM-2300F, manufactured by JEOL Ltd.), of a white region (eutectic phase) in FIG. 9. An EDX analysis indicated that the white regions were copper and the black regions were $Cu_9Zr_2$. In addition, the presence of $Cu_9Zr_2$ was confirmed by analyzing a diffraction image by selected-area diffraction and measuring the lattice parameters of a plurality of diffraction planes. Thus, it was demonstrated that the eutectic phase in FIG. 11 had a double fibrous structure in which copper and $Cu_9Zr_2$ were arranged alternately at a substantially regular pitch, namely, about 20 nm. The phase pitch is the pitch of the alternately arranged copper and $Cu_9Zr_2$ measured by STEM observation of the eutectic phases. When the lattice image of the eutectic phase shown in FIG. 11 was observed by STEM at a magnification of 2,500,000 times in a field of view of 50 nm×50 nm, about 15% of amorphous phases were recognized in terms of area fraction in the field of view (eutectic phase). FIG. 12 schematically shows the amorphous phases in the eutectic phase. The amorphous phases were mainly formed at the interfaces between the copper matrix phases and the $Cu_9Zr_2$ compound phases, presumably contributing to maintaining sufficient mechanical strength. The amorphous fraction was determined by measuring the area fraction of possible amorphous regions where atoms were randomly arranged in the lattice image. In addition, when, the copper structure in FIG. 11, which looks white, was observed by STEM, the difference in orientation between the adjacent fine crystals was extremely small, namely, about 1° to 2°. This suggests that large shear slip deformation occurred in copper in the drawing direction without aggregation of dislocations. This presumably allows wire drawing at high drawing ratio without causing a break during the cold working.

Measurement of Ultimate Tensile Strength

The ultimate tensile strength was measured according to JIS Z2201 using a universal testing machine (Autograph AG-1kN, manufactured by Shimadzu Corporation). The ultimate tensile strength of each copper alloy wire was determined by dividing the maximum load by the initial cross-sectional area.

Measurement of Electrical Conductivity

The electrical conductivity of each wire was determined by measuring the electrical resistivity (volume resistivity) of the wire at room temperature according to JIS H0505 using a four-electrode electrical resistivity meter, calculating the ratio of the measured electrical resistivity to the resistivity (1.7241 μΩcm) of annealed pure copper (standard soft copper having an electrical resistivity of 1.7241 μΩcm at 20° C.), and converting it to electrical conductivity (% IACS: International Annealed Copper Standard). The conversion was performed by the following equation: electrical conductivity $\gamma$ (% IACS)=1.7241/volume resistivity $\rho$×100.

Experimental Results

As shown in Table 1, when the zirconium content fell below 3.0 atomic percent, the ultimate tensile strength was decreased (Comparative Example 1). The reason is presumably that an amount of eutectic phases large enough to ensure sufficient strength was not formed because the zirconium content was low. On the other hand, when the zirconium content exceeded 7.0 atomic percent, no desired wire could be obtained because a break occurred during the wire drawing (Comparative Example 2) or a crack occurred during the casting (Comparative Example 3). In addition, even though the zirconium content fell within the range of 3.0 to 7.0 atomic percent, the ultimate tensile strength was decreased when the secondary DAS of the casting structure was excessive (Comparative Example 4) or the reduction of area fell below 99.00% (Comparative Example 5). This is presumably because an amount of eutectic phases large enough to ensure sufficient strength was not formed. In contrast, Examples 1 to 27 achieved an ultimate tensile strength exceeding 1,300 MPa and an electrical conductivity exceeding 20% IACS without suffering a casting crack or a break during the production. Thus, it was demonstrated that the production method of the present invention provides a desired copper alloy wire by cold working without heat treatment. In addition, it was demonstrated that the casting diameter, the secondary DAS, and the reduction of area can be appropriately controlled for a particular composition to achieve the desired eutectic phase fraction, the desired phase pitch of copper and $Cu_9Zr_2$ in the eutectic phases, and the desired amorphous fraction, thus achieving an ultimate tensile strength exceeding 1,300, 1,500, or 1,700 MPa and an electrical conductivity exceeding 20% IACS. In particular, it was demonstrated that the ultimate tensile strength becomes higher with increasing zirconium content, increasing eutectic phase fraction, and increasing amorphous fraction. Hence, presumably the copper matrix phases contribute to electrical conductivity as a path for free electrons, whereas the eutectic phases contribute to ultimate tensile strength. In the eutectic phases, additionally, presumably copper contributes to electrical conductivity, whereas the eutectic phases contribute to ultimate tensile strength. It was also demonstrated that a high-strength copper alloy wire having such wire properties can be achieved as-drawn with a diameter of 0.100, 0.040, or 0.010 mm or less.

In the above experiment, the properties of other-element-free materials produced so as to contain as small amounts of elements other than copper and zirconium as possible were examined. To examine the properties of other-element-containing materials produced so as to contain elements other than copper and zirconium, the following experiment was further carried out.

Example 28

First, an alloy containing 3.0 atomic percent of zirconium and 700 to 2,000 ppm by mass of oxygen with the balance being copper was put into a quartz nozzle having a tap hole in the bottom surface thereof, and after the nozzle was evacuated to $5\times10^{-2}$ Pa and was then purged with argon gas to nearly the atmospheric pressure, the alloy was melted into liquid metal in an arc melting furnace while applying a pressure of 0.5 MPa to the liquid surface. Next, a pure copper mold having a round-bar-shaped cavity with a diameter of 3 mm and a length of 60 mm was coated, and the melt of about 1,200° C. was poured and cast into a round-bar ingot. The melt was poured by opening the tap hole formed in the bottom surface of the quartz nozzle while applying pressure with argon gas. Next, the round-bar ingot, which had been cooled to room temperature, was subjected to cold drawing to a diameter of 0.5 mm using a cemented carbide die at room temperature and was then subjected to continuous cold wire drawing to a diameter of 0.160 mm using diamond dies, thus producing a wire of Example 28. The continuous wire drawing was performed with the wire and the diamond dies immersed in a bath filled with an aqueous liquid lubricant. During this process, the liquid lubricant in the bath was cooled with a cooling pipe using liquid ethylene glycol as a coolant. The reduction of area at which the 3 mm round-bar ingot was drawn to a diameter of 0.5 mm was 97.2%, and the reduction of area at which the 3 mm round-bar ingot was drawn to a diameter of 0.160 mm was 99.7%.

Example 29

A wire of Example 29 was produced in the same manner as in Example 28 except that wire drawing was performed so that the diameter after the wire drawing was 0.040 mm.

Examples 30 to 34

A wire of Example 30 was produced in the same manner as in Example 28 except that an alloy containing 4.0 atomic percent of zirconium and 700 to 2,000 ppm by mass of oxygen with the balance being copper was used and that wire drawing was performed so that the diameter after the wire drawing was 0.200 mm. In addition, a wire of Example 31 was produced in the same manner as in Example 30 except that wire drawing was performed so that the diameter after the wire drawing was 0.160 mm. In addition, a wire of Example 32 was produced in the same manner as in Example 30 except that wire drawing was performed so that the diameter after the wire drawing was 0.070 mm. In addition, a wire of Example 33 was produced in the same manner as in Example 30 except that wire drawing was performed so that the diameter after the wire drawing was 0.040 mm. In addition, a wire of Example 34 was produced in the same manner as in Example 30 except that wire drawing was performed so that the diameter after the wire drawing was 0.027 mm.

Examples 35 to 36

A wire of Example 35 was produced in the same manner as in Example 28 except that an alloy containing 5.0 atomic percent of zirconium and 700 to 2,000 ppm by mass of oxygen with the balance being copper was used and that wire drawing was performed so that the diameter after the wire drawing was 0.160 mm. In addition, a wire of Example 36 was produced in the same manner as in Example 35 except that wire drawing was performed so that the diameter after the wire drawing was 0.040 mm.

Comparative Example 6

A wire of Comparative Example 6 was produced in the same manner as in Example 30 except that wire drawing was performed so that the diameter after the wire drawing was 0.500 mm.

Derivation of Drawing Ratio

First, the cross-sectional area $A_0$ of each ingot before the wire drawing was determined from the diameter thereof, and the cross-sectional area $A_1$ after the wire drawing was determined from the diameter of the copper alloy wire. From these values, the drawing ratio $\eta$ represented by the equation $\eta=\ln(A_0/A_1)$ was determined.

Observation of Casting Structure

Figure 13:
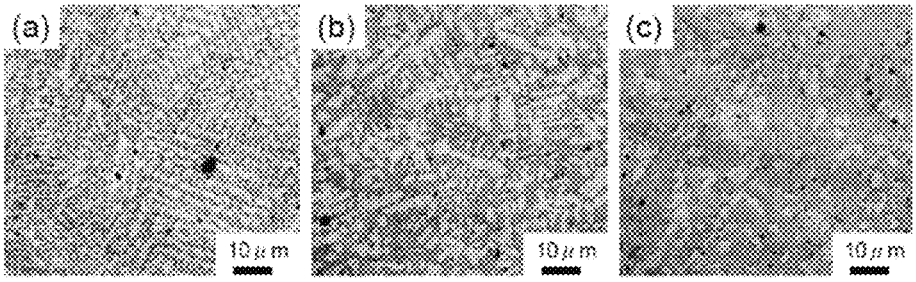
FIG. 13 is a set of optical micrographs of the casting structures of ingots containing 3.0 to 5.0 atomic percent of zirconium.

The ingots before the wire drawing were cut in a circular cross-section perpendicular to the axial direction (hereinafter also referred to as "lateral cross-section"), were mirror-polished, and were observed by optical microscopy. FIG. 13 is a set of optical micrographs of the casting structures of the ingots containing 3.0 to 5.0 atomic percent of zirconium. FIG. 13(*a*) shows the casting structures of the ingots of Examples 28 and 29 containing 3.0 atomic percent of zirconium, FIG. 13(*b*) shows the casting structures of the ingots of Examples 30 to 34 containing 4.0 atomic percent of zirconium, and FIG. 13(*c*) shows the casting structures of the ingots of Examples 35 and 36 containing 5.0 atomic percent of zirconium. The bright regions are proeutectic α-copper phases (copper matrix phases), and the dark regions are eutectic phases (composite phases). FIG. 13 demonstrates that the amount of eutectic phases increases with increasing zirconium content. The secondary DAS was measured using the optical micrographs. In FIG. 13(*a*), the secondary DAS was 2.7 μm. In FIGS. 13(*b*) and 13(*c*), however, the secondary DAS could not be determined because the dendrite arms became nonuniform as the amount of α-copper phases decreased with increasing zirconium content.

Figure 14:
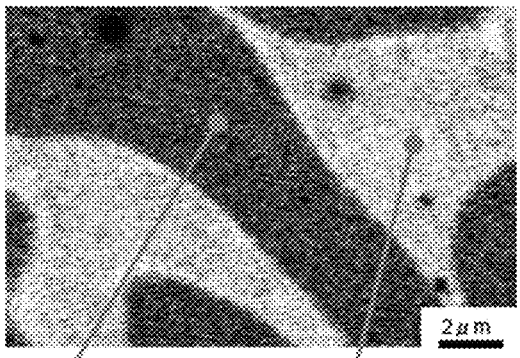
FIG. 14 is an SEM photograph of the casting structures of an ingots containing 3.0 atomic percent of zirconium.

In addition, the ingots before the wire drawing were cut in a circular cross-section perpendicular to the axial direction, were mirror-polished, and were observed by SEM. FIG. 14 is an SEM photograph (composition image) of the casting structures of the ingots of Examples 28 and 29 containing 3.0 atomic percent of zirconium. According to an EDX analysis of the bright and dark regions in the structure, the bright regions contained 93.1 atomic percent of copper and 6.9 atomic percent of zirconium, and the dark regions contained 99.7 atomic percent of copper and 0.3 atomic percent of zirconium. This demonstrates that the bright regions were eutectic phases (composite phases) and the dark regions were α-copper phases (copper matrix phases). Because the solid solubility limit of zirconium in the copper phases is 0.12 atomic percent in the equilibrium diagram of copper-zirconium alloy, the fact that 0.3 atomic percent of zirconium was dissolved in the copper phases of the ingots of the copper alloys containing 3 atomic percent of zirconium suggests that the solid solubility limit of zirconium in the copper phases was extended as a result of solidification by quenching.

Observation of Structure after Wire Drawing

Figure 15:
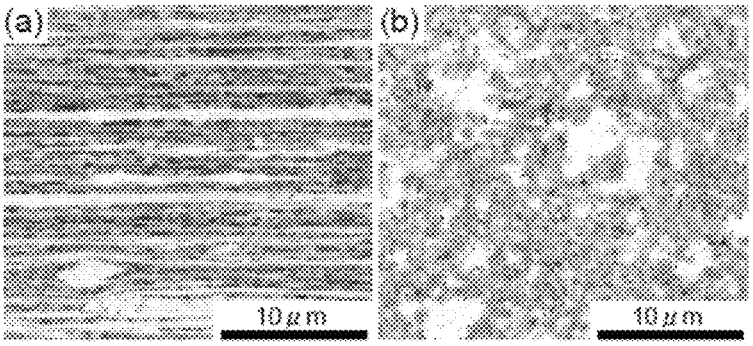
FIG. 15 is a set of SEM photographs of the cross-sections of the copper alloy wire of Example 28.
Figure 16:
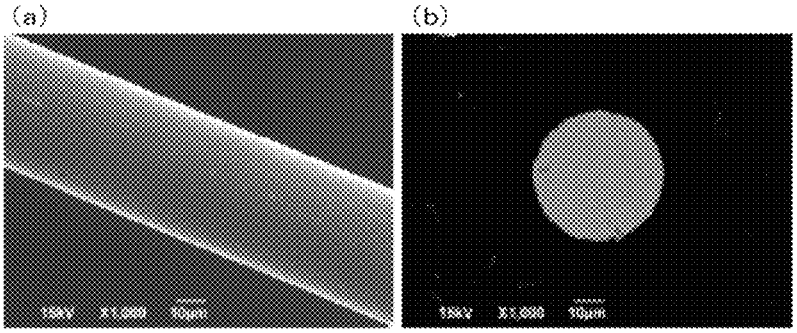
FIG. 16 is a set of SEM photographs of the surface of the copper alloy wire of Example 36.

The copper alloy wires after the wire drawing were cut in a circular cross-section perpendicular to the axial direction (hereinafter referred to as "lateral cross-section") and a cross-section parallel to the axial direction and including the central axis (hereinafter also referred to as "longitudinal cross-section"), were mirror-polished, and were observed by SEM. FIG. 15 is a set of SEM photographs (composition images) of the cross-sections of the copper alloy wire of Example 28 (copper alloy containing 3 atomic percent of zirconium; $\eta$=5.9). The lateral cross-section was nearly a perfect circle, and no damage, such as a crack, other than scratches formed during the working was observed in the side surface. This demonstrates that high-strain wire drawing can be performed without heat treatment. FIG. 16 is a set of SEM photographs of the surface of the copper alloy wire of Example 36 (copper alloy containing 5 atomic percent of zirconium; $\eta$=8.6). The surface of the wire was smooth only with some scratches, demonstrating that continuous cold wire drawing can be performed without annealing. In addition, for example, as shown in Table 2, it was demonstrated that wire drawing without heat treatment can be performed at least at a drawing ratio $\eta$ of 8.6 to a minimum diameter of 40 μm. Furthermore, it was demonstrated that wire drawing without heat treatment can be performed at least at a drawing ratio $\eta$ of 9.4 to a minimum diameter of 27 μm. As observed in the longitudinal cross-section shown in FIG. 15(*a*), the α-copper phases and the eutectic phases were arranged in a staggered manner to form a fibrous structure extending in one direction. As observed in the lateral cross-section in FIG. 15(*b*), additionally, the casting structure of the α-copper phases and the eutectic phases of the ingot was broken. In addition, fine particles dispersed in a black spot pattern were observed in the α-copper phases. An EDX analysis of these particles detected oxygen in an amount 4.7 times the amount of oxygen in the eutectic phases as well as copper and zirconium, suggesting the presence of oxide. The bright regions (eutectic phases) and the dark regions (α-copper phases) in the structure in the lateral cross-section in FIG. 15(*b*) were binarized, and the area fraction of the eutectic phases was determined to be 43%. Among the examples where n=5.9, the area fraction of the eutectic phases was 49% in Example 31 (copper alloy containing 4 atomic percent of zirconium) and was 55% in Example 35 (copper alloy containing 5 atomic percent of zirconium). This demonstrates that the area fraction of the eutectic phases increases with the zirconium content.

TABLE 2

| | | | | | | | |
|---|---|---|---|---|---|---|---|
| Diameter/mm | 3.0 | 0.5 | 0.2 | 0.16 | 0.07 | 0.04 | 0.027 |
| Reduction of area/% | 0 | 97.2 | 99.6 | 99.7 | 99.9 | 99.99 | 99.99 |
| Drawing ratio, η | 0 | 3.6 | 5.4 | 5.9 | 7.5 | 8.6 | 9.4 |

Figure 17:
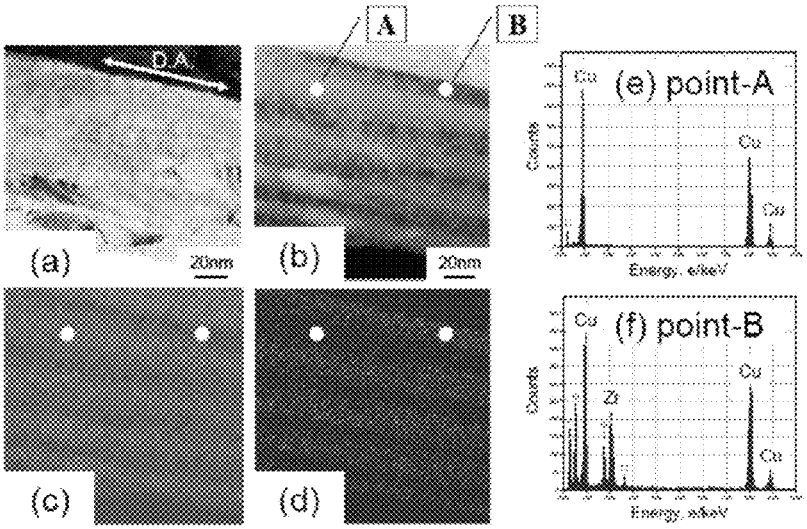
FIG. 17 is a set of STEM photographs of a eutectic phase in the copper alloy wire of Example 31.
Figure 18:
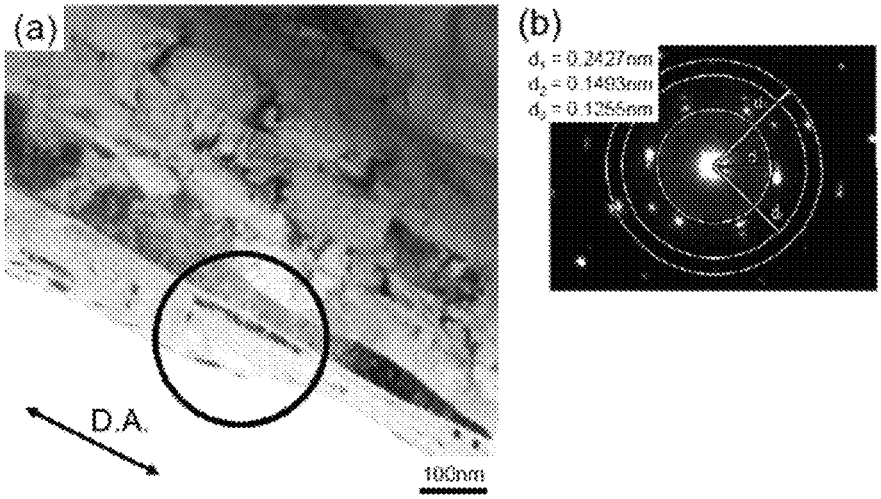
FIG. 18 is a set of STEM photographs of a eutectic phase in the copper alloy wire of Example 31.

FIG. 17 is a set of STEM photographs of a eutectic phase in the copper alloy wire of Example 31 (copper alloy containing 4 atomic percent of zirconium; η=5.9). FIG. 17(*a*) shows a bright-field (BF) image, FIG. 17(*b*) shows a high-angle annular dark-field (HAADF) image, FIG. 17(*c*) shows an elemental map of Cu—Kα, FIG. 17(*d*) shows an elemental map of Zr-Lα, FIG. 17(*e*) shows the results of an elemental analysis at point A in the bright regions in FIG. 17(*b*), and FIG. 17(*f*) shows the results of an elemental analysis at point B in the dark regions in FIG. 17(*b*). The arrow in the BF image indicates the orientation of the drawing axis (DA). In the HAADF image, the bright regions and the dark regions formed a layered structure and were arranged at a pitch of about 20 nm. It was demonstrated that the bright regions were α-copper phases and the dark regions were compound phases containing copper and zirconium. The ratio of the α-copper phases to the compound phases containing copper and zirconium observed in the image was measured to be about 60:40 to 50:50, suggesting that the rule of mixture also applies to the interiors of the eutectic phases. FIG. 18 is a set of STEM photographs of a eutectic phase in the copper alloy wire of Example 31 (copper alloy containing 4 atomic percent of zirconium; η=5.9). FIG. 18(*a*) shows an STEM-BF image, and FIG. 18(*b*) shows a selected-area electron beam diffraction (SAD) image taken from the circle shown in FIG. 18(*a*). In the SAD image in FIG. 18(*b*), ring patterns were observed aside from diffraction spots, which indicate the copper phases. The lattice parameters of the three diffraction rings shown in FIG. 18(*b*) were determined to be $d_1$=0.2427 nm, $d_2$=0.1493 nm, and $d_3$=0.1255 nm, respectively. On the other hand, Table 3 compares the lattice parameters of the (202), (421), and (215) planes of $Cu_9Zr_2$ determined by Glimois et al. The lattice parameters shown above can be assumed to be equivalent to those in Table 3 within the limits of error, suggesting that the compound observed in FIG. 18(*a*) that contained copper and zirconium was $Cu_9Zr_2$.

TABLE 3

| Phase | Pearson symbol | Lattice plane | Lattice parameter (nm) |
|---|---|---|---|
| $Cu_9Zr_2$ | tP24 | (202) | 0.2429 |
| | | (421) | 0.1496 |
| | | (215) | 0.1256 |

Measurement of Ultimate Tensile Strength and Electrical Conductivity

Figure 19:
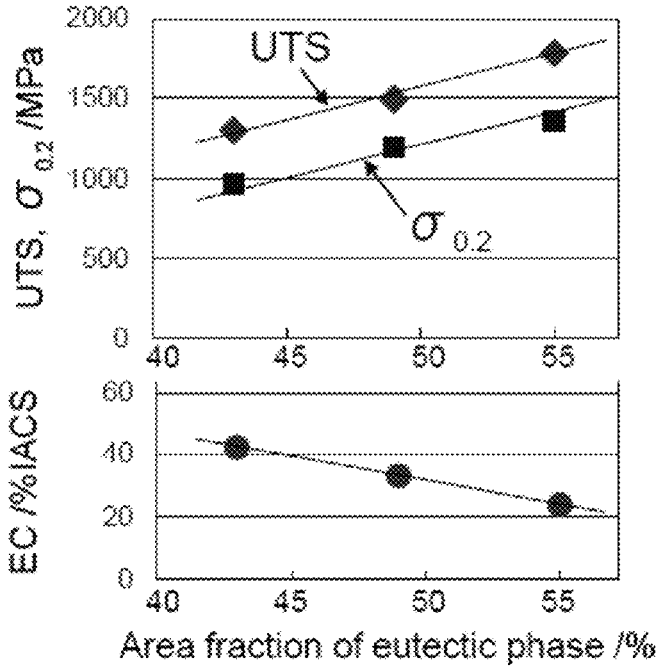
FIG. 19 is a set of graphs showing the relationships between eutectic phase fraction and EC, UTS, and $\sigma_{0.2}$ of the examples where drawing ratio $\eta$ was 5.9.

FIG. 19 is a set of graphs showing the relationships between the area fraction of eutectic phases (eutectic phase fraction) and the electrical conductivity (EC), ultimate tensile strength (UTS), and 0.2% offset yield strength ($\sigma_{0.2}$) of the examples where the drawing ratio η was 5.9, namely, Example 28 (copper alloy containing 3 atomic percent of zirconium), Example 31 (copper alloy containing 4 atomic percent of zirconium), and Example 35 (copper alloy containing 5 atomic percent of zirconium). The EC decreased with increasing area fraction of the eutectic phases. Conversely, the UTS and the $\sigma_{0.2}$ both increased with increasing area fraction of the eutectic phases. The decrease in EC is presumably related to the fact that the amount of α-copper phases decreased relatively as the area fraction of the eutectic phases increased, whereas the increases in UTS and $\sigma_{0.2}$ are presumably related to the fact that the amount of $Cu_9Zr_2$ compound phases in the eutectic phases increased relatively as the area fraction of the eutectic phases increased.

Figure 20:
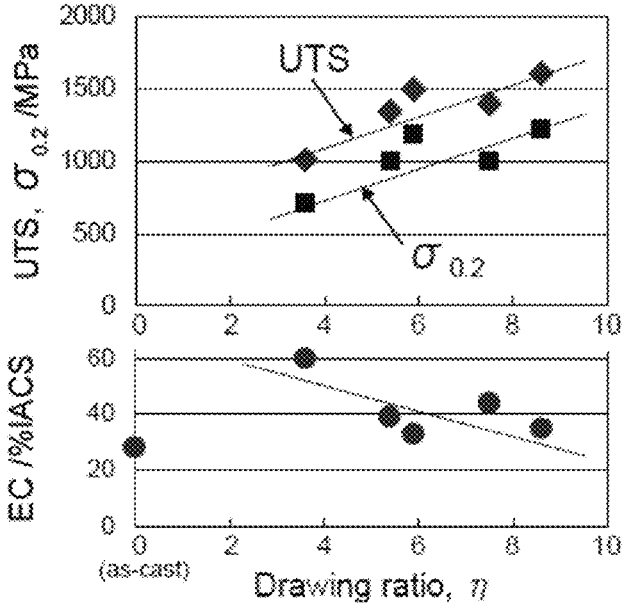
FIG. 20 is a set of graphs showing the relationships between the drawing ratio $\eta$ and the EC, UTS, and $\sigma_{0.2}$ of copper alloy wires containing 4.0 atomic percent of zirconium.

FIG. 20 is a set of graphs showing the relationships between the drawing ratio η and the EC, UTS, and $\sigma_{0.2}$ of Examples 30 to 34, which are copper alloy wires containing 4.0 atomic percent of zirconium. The EC of the ingots, that is, as-cast, was 28% IACS; the EC of the copper alloy wires after the wire drawing was higher than that of the ingots and was maximized around η=3.6, but decreased at higher drawing ratios. The UTS and the $\sigma_{0.2}$, on the other hand, increased linearly with increasing drawing ratio.

Figure 21:
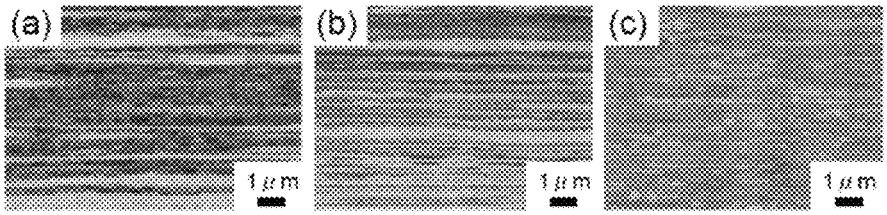
FIG. 21 is a set of SEM photographs of longitudinal cross-sections of the copper alloy wires containing 4.0 atomic percent of zirconium.

FIG. 21 is a set of SEM photographs of longitudinal cross-sections of the copper alloy wires containing 4.0 atomic percent of zirconium, where FIG. 21(*a*) shows Example 31 (η=5.9), FIG. 21(*b*) shows Example 32 (η=7.5), and FIG. 21(*c*) shows Example 33 (η=8.6). It was demonstrated that the layered structure of the α-copper phases and the eutectic phases changes to a denser structure including thinner layers with increasing drawing ratio. This change of the layered structure is presumably related to the relationships between the drawing ratio η and the EC, UTS, and $\sigma_{0.2}$ shown in FIG. 20. Furthermore, presumably the layered structure of the copper phases and the $Cu_9Zr_2$ compound phases formed in the eutectic phases changes with the drawing ratio η and affects the electrical and mechanical properties.

Figure 22:
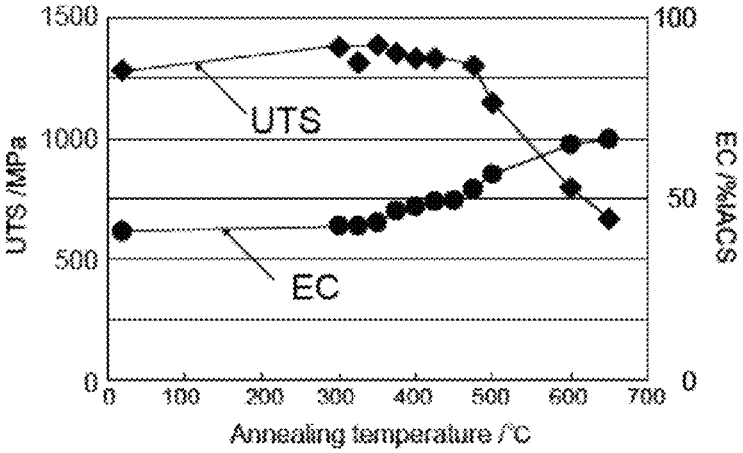
FIG. 22 is a graph showing the relationships between the annealing temperature and the EC and UTS of annealed samples of the copper alloy wire of Example 28.

FIG. 22 is a graph showing the relationships between the annealing temperature and the EC and UTS of annealed samples of the copper alloy wire of Example 28 (copper alloy containing 3 atomic percent of zirconium; η=5.9). The annealing was performed by maintaining the samples at various temperatures within the range of 300° C. to 650° C. for 900 seconds and then cooling them in the furnace. The EC remained nearly the same within the range of room temperature to 300° C., but increased gradually at higher temperatures. The UTS was maximized at 350° C., decreased gradually, and decreased abruptly above 475° C. One possible cause for this is precipitation of zirconium dissolved in the α-copper phases. The electrical and mechanical properties of the drawn wire, which are presumably affected by the structure, were relatively stable up to 475° C., whereas the structure presumably changed at higher temperatures. This suggests that the copper alloy wire of the present invention can be stably used up to 475° C.

Figure 23:
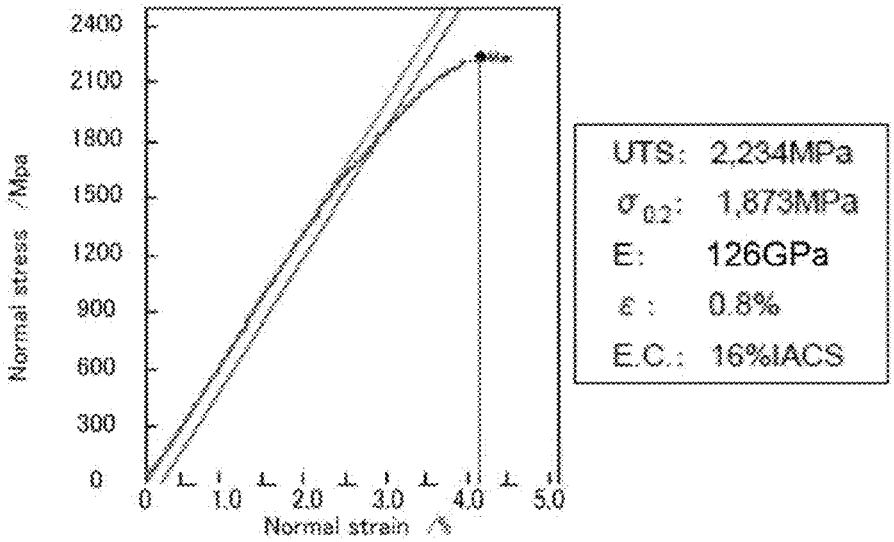
FIG. 23 is a graph showing the nominal S-S curve of the copper alloy wire of Example 36.

FIG. 23 is a graph showing the nominal S-S curve of the copper alloy wire of Example 36 (copper alloy containing 5 atomic percent of zirconium; η=8.6). The ultimate tensile strength was 2,234 MPa, the 0.2% offset yield strength was 1,873 MPa, the Young's modulus was 126 GPa, and the elongation was 0.8%. In addition, the electrical conductivity was 16% IACS. This demonstrates that it is possible to achieve an ultimate tensile strength of 2,200 MPa or more, an electrical conductivity of 15% AICS or more, and a Young's modulus of 110 to 140 GPa or more. In addition, whereas the ultimate tensile strength exceeded 2 GPa, the Young's modulus was about half that of a practical copper alloy, demonstrating that the break elongation is generally high.

Figure 24:
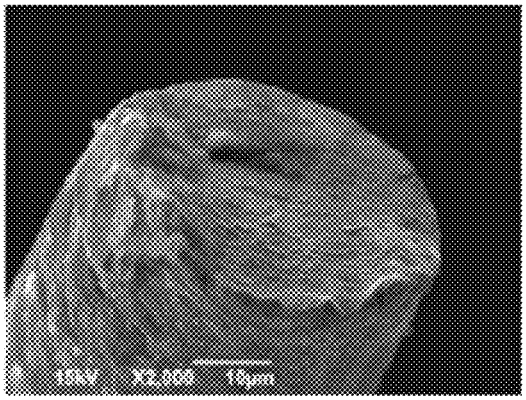
FIG. 24 is an SEM photograph of fracture surface of the copper alloy wire of Example 36 after measurement of ultimate tensile strength.

FIG. 24 is an SEM photograph of the fracture surface of the copper alloy wire of Example 36 (copper alloy containing 5 atomic percent of zirconium; $\eta$=8.6) after the tensile test. A vein pattern was partially observed, indicating the fracture properties of amorphous alloys.

Figure 25:
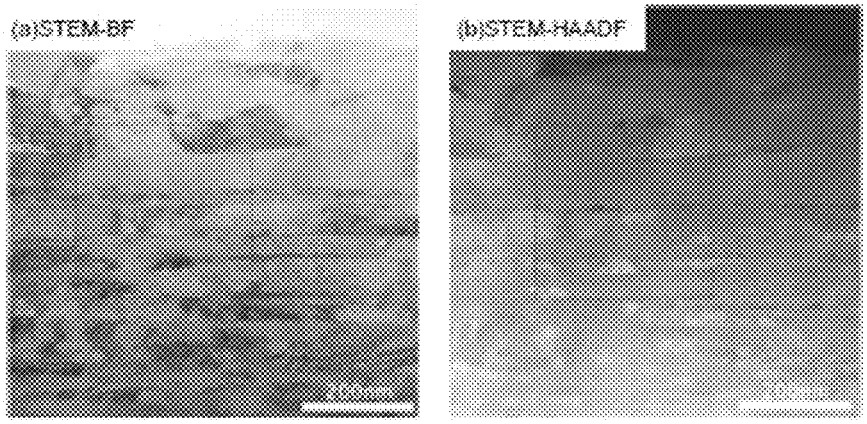
FIG. 25 is a set of STEM photographs of a composite phase in a longitudinal cross-section of the copper alloy wire of Example 33.

FIG. 25 is a set of STEM photographs of a composite phase in a longitudinal cross-section of the copper alloy wire of Example 33 (copper alloy containing 4 atomic percent of zirconium; $\eta$=8.6). FIG. 25(*a*) shows a BF image, and FIG. 25(*b*) shows an HAADF image. In FIG. 25, layered copper phases having a width of about 10 to 70 nm and $Cu_9Zr_2$ phases extending from the ends thereof in a stringer pattern were observed. The $Cu_9Zr_2$ phases extending in a stringer pattern had an average width of not more than 10 nm, demonstrating that they become thinner (finer) with increasing drawing ratio. Thus, presumably the ultimate tensile strength can be increased, for example, as the copper-zirconium compound phases, such as the $Cu_9Zr_2$ phases, become finer, and particularly, can be further increased if the average width is 10 nm or less. The copper phases, which are easy to recognize in the BF image in FIG. 25(*a*), are layered regions. The $Cu_9Zr_2$ phases, which are easy to recognize in the HADDF image in FIG. 25(*b*), are black regions extending in a stringer pattern. In addition, as observed in the BF image in FIG. 25(*a*), deformation twins also appeared in the copper phases at an angle of about 20° to 40° with respect to the drawing axis.

Table 4 shows the results of a quantitative analysis by the ZAF method on the $Cu_9Zr_2$ phases and the copper phases in the composite phases and the copper matrix phases ($\alpha$-copper phases) of the copper alloy wire of Example 33 (copper alloy containing 4 atomic percent of zirconium; $\eta$=8.6). According to Table 4, the $Cu_9Zr_2$ contained oxygen. This oxygen presumably increased the ultimate tensile strength by making the copper alloy more amorphous. On the other hand, no oxygen was contained in the copper matrix phases or the copper phases in the composite phases. In addition, silicon was contained in both the $Cu_9Zr_2$ phases and the copper phases in the composite phases. This silicon was presumably derived from the quartz nozzle. Rather than silicon, presumably aluminum may be contained. For example, presumably aluminum is contained if, for example, an alumina nozzle is used.

TABLE 4

| | Phase | O—K 8 | Si—K 14 | Cu—K 29 | Zr-L 40 | mean Z — |
|---|---|---|---|---|---|---|
| Point 1 | $Cu_9Zr_2$ | 26.10 | 3.77 | 57.35 | 12.78 | 24.4 |
| Point 2 | Cu | — | 0.93 | 99.07 | — | 28.9 |
| Point 3 | $Cu_9Zr_2$ | 43.81 | 14.54 | 18.24 | 23.41 | 20.2 |
| Point 4 | Cu | — | 7.90 | 92.10 | — | 27.8 |
| Point 5 | Cu | — | — | 100.00 | — | 29.0 |
| Point 6 | Cu | — | — | 100.00 | — | 29.0 |

Figure 26:
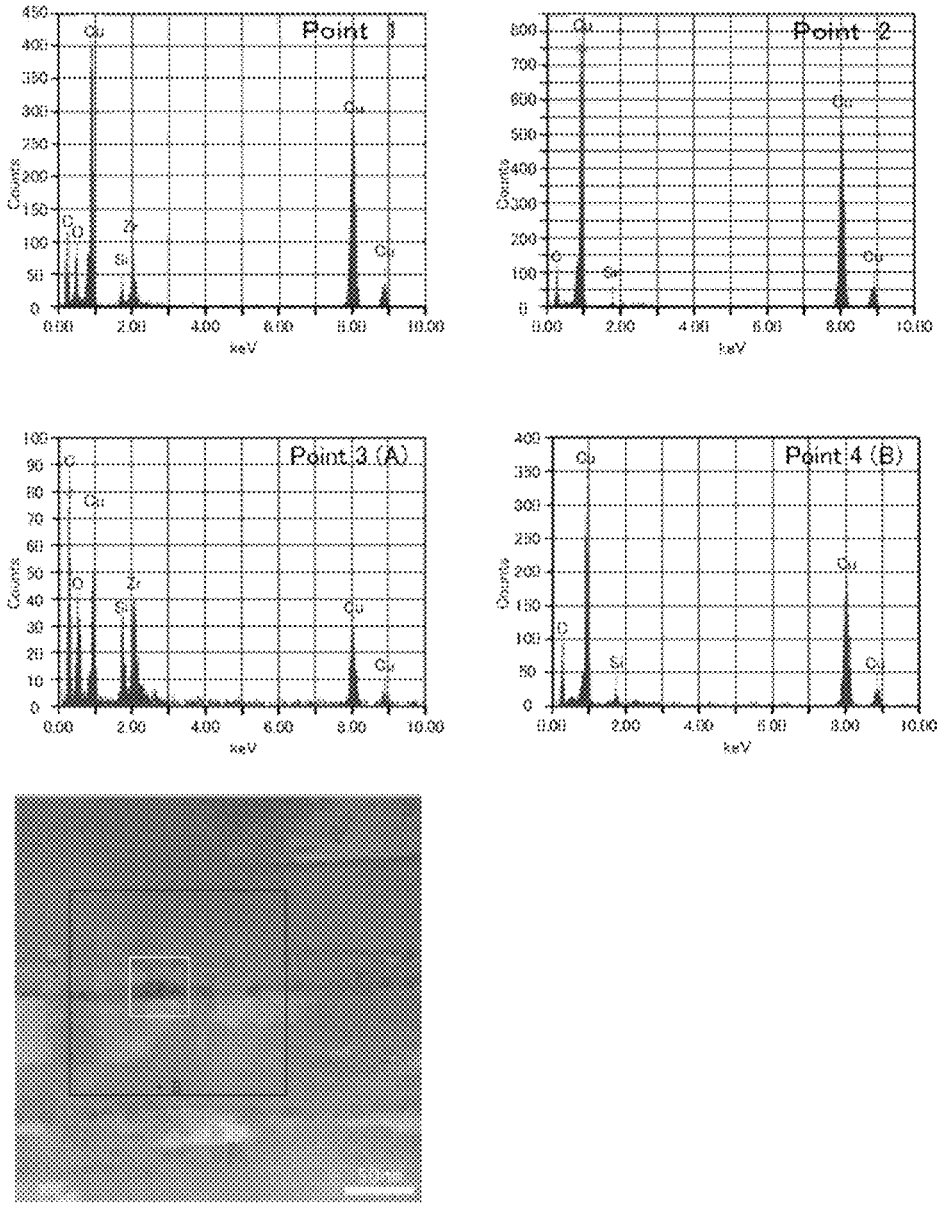
FIG. 26 shows the results of an EDX analysis of a eutectic phase in the copper alloy wire of Example 33.
Figure 27:
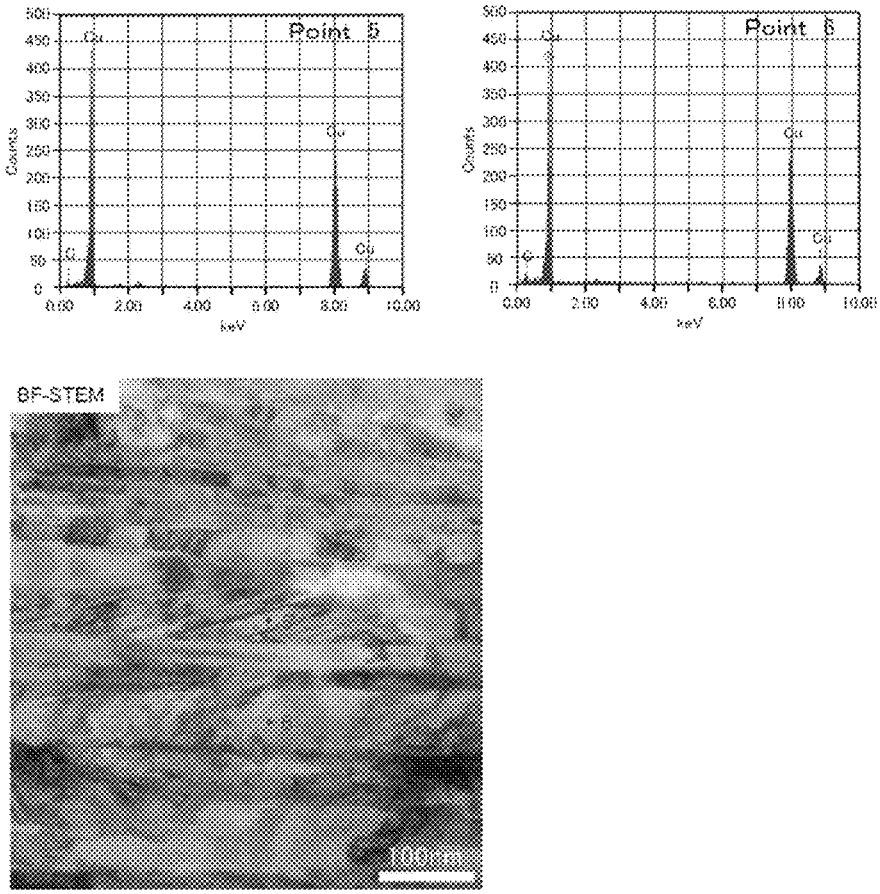
FIG. 27 shows the results of an EDX analysis of a copper matrix phase in the copper alloy wire of Example 33.

FIG. 26 shows the results of an EDX analysis of a eutectic phase (points 1 to 4) in the copper alloy wire of Example 33 (copper alloy containing 4 atomic percent of zirconium; $\eta$=8.6). In addition, FIG. 27 shows the results of an EDX analysis of a copper matrix phase (points 5 and 6) in the copper alloy wire of Example 33. Points 1 to 6 correspond to points 1 to 6, respectively, shown in Table 4. The photograph shown in FIG. 26 is an STEM-HAADF image that is a magnified photograph of the enclosed region in FIG. 25, and points A and B in the STEM-HAADF image correspond to points 3 and 4, respectively. At the points in the $Cu_9Zr_2$ phases, which look dark in the STEM-HAADF image, large amounts of oxygen and silicon were contained, and the mean atomic number Z calculated from the oxygen, silicon, copper, and zirconium concentrations quantified by the ZAF method was 20.2, demonstrating that the mean atomic number Z was apparently lower than that of copper, namely, 29. This is presumably the reason why the $Cu_9Zr_2$ phases look darker than the copper phases. The STEM-HAADF image of the field of view in which the EDX analysis was performed at points 1 and 2 is not shown. On the other hand, the photograph shown in FIG. 27 is an STEM-BF image of a copper matrix phase ($\alpha$-copper phase), and points 5 and 6 in the STEM-BF image correspond to points 5 and 6, respectively. In the STEM-BF image, a layered structure was found in the $\alpha$-copper phase, and deformation twins were partially observed therein. The average width of the individual layers, that is, copper phases, in the layered structure was not more than 100 nm. Thus, if a layered structure is formed in the $\alpha$-copper phases, presumably the ultimate tensile strength can be increased by the effect similar to the Hall-Petch law, and can be further increased if the average width of the copper phases is 100 nm or less. In addition, the deformation twins were formed so as not to straddle the boundaries between the copper phases. These deformation twins were oriented at an angle of 20° to 40° with reference to the axial direction and occupied 0.1% to 5% of the copper matrix phase. If such deformation twins are contained, presumably the ultimate tensile strength can be increased as a result of twinning without significantly decreasing the electrical conductivity. It was confirmed that they were not traces of ion milling. In addition, it was demonstrated that the copper matrix phases contained no oxygen or silicon, or only trace amounts of oxygen and silicon that could not be quantified by the ZAF method. In addition, no sign of formation of dislocation substructures, where the dislocation density is clearly high, was recognized in the $\alpha$-copper phases or the copper-zirconium compound phases, demonstrating that almost no dislocations were present at least in a longitudinal cross-section. In general, dislocations tend to increase with increasing drawing ratio; in the case of the present application, presumably dislocations increased negligibly because they were absorbed into, for example, the boundaries between the phases or the deformation twins, or disappeared. Accordingly, good electrical conductivity was achieved presumably because almost no dislocations were present in the axial direction. This also applied to other examples, such as those where the zirconium content was 5 atomic percent.

Figure 28:
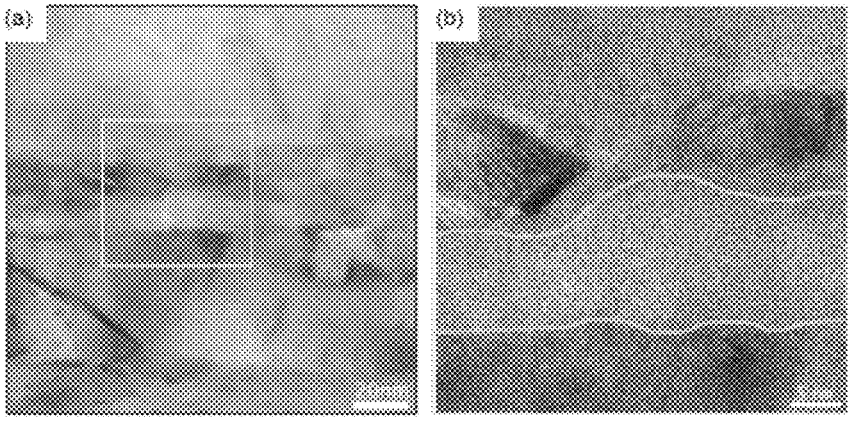
FIG. 28 is a set of STEM-BF images of the copper alloy wire of Example 33.

FIG. 28 is a set of STEM-BF images of the copper alloy wire of Example 33 (copper alloy containing 4 atomic percent of zirconium; $\eta$=8.6), showing the results of observations of the enclosed regions in the STEM-HAADF image in FIG. 26. FIG. 28(*a*) shows an STEM-BF image of the larger frame in FIG. 26, and FIG. 28(*b*) shows an STEM-BF image of the smaller frame in FIG. 26. Although the copper phases were shaded at some observation sites, lattice fringes were observed. In the $Cu_9Zr_2$ phase enclosed by the solid lines, on the other hand, no lattice fringe was observed, demonstrating that the $Cu_9Zr_2$ phase was amorphous. In FIG. 28, the area fraction of the amorphous phase was determined to be about 31%. This demonstrates that amorphous phases tend to be formed in copper-zirconium compound phases such as $Cu_9Zr_2$ phases. In this regard, presumably the $Cu_9Zr_2$ phases may be amorphous phases in the entirety thereof, rather than in part.

Figure 29:
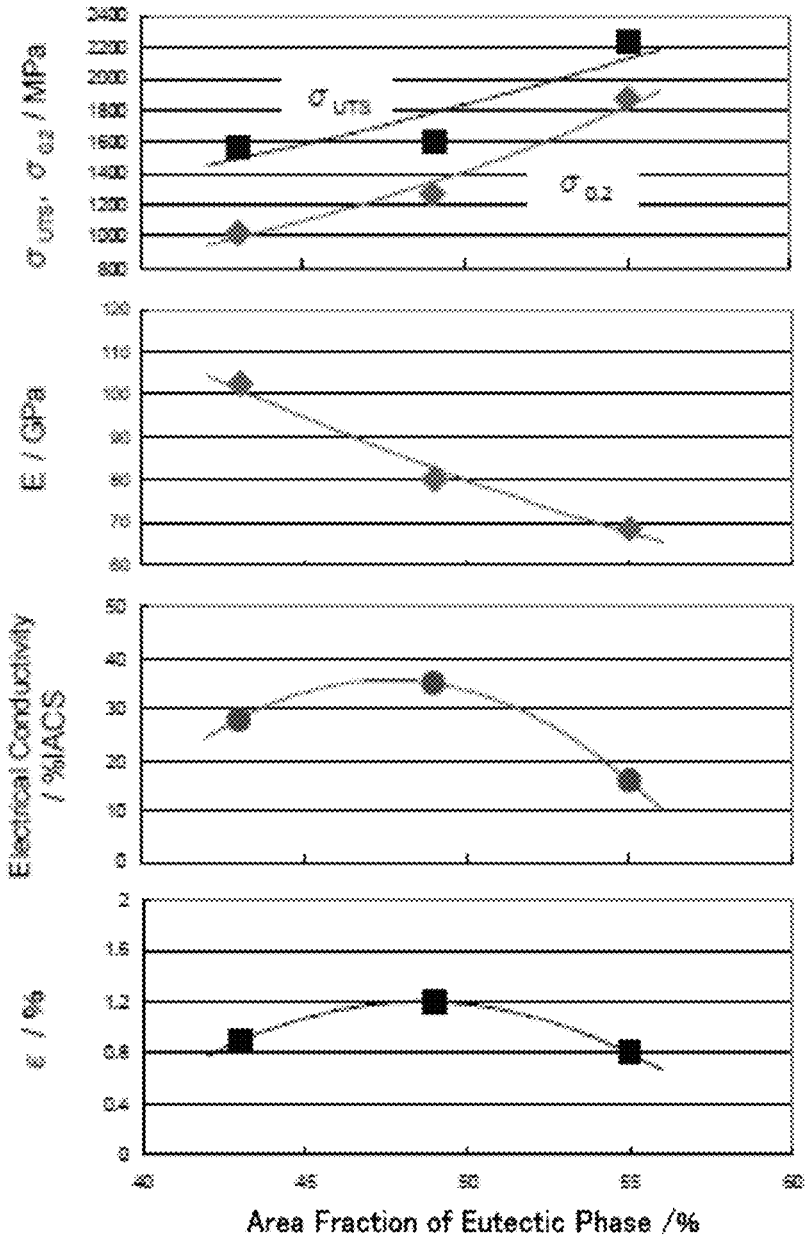
FIG. 29 is a set of graphs showing the relationships between the eutectic phase fraction measured at a drawing ratio $\eta$ of 5.9 and UTS, $\sigma_{0.2}$ Young's modulus, EC, elongation of copper alloy wires where drawing ratio $\eta$ was 8.6.

FIG. 29 is a set of graphs showing the relationships between the eutectic phase fraction measured in a lateral cross-section at a drawing ratio $\eta$ of 5.9 (intermediate diameter: 160 μm) and the UTS, $\sigma_{0.2}$, Young's modulus, EC, and elongation of the copper alloy wires of the examples where the drawing ratio $\eta$ was 8.6, namely, Example 29 (copper alloy containing 3 atomic percent of zirconium), Example 33 (copper alloy containing 4 atomic percent of zirconium), and Example 36 (copper alloy containing 5 atomic percent of zirconium). It was demonstrated that the UTS and the $\sigma_{0.2}$ increase with increasing eutectic phase fraction. It was also demonstrated that the Young's modulus decreases with increasing eutectic phase fraction. It was also demonstrated that the EC and the elongation are maximized when the eutectic phase fraction is about 50%. The individual properties are presumably related to the presence of the $Cu_9Zr_2$ compound phases and the structural change (becoming more amorphous) in the eutectic phases.

Figure 30:
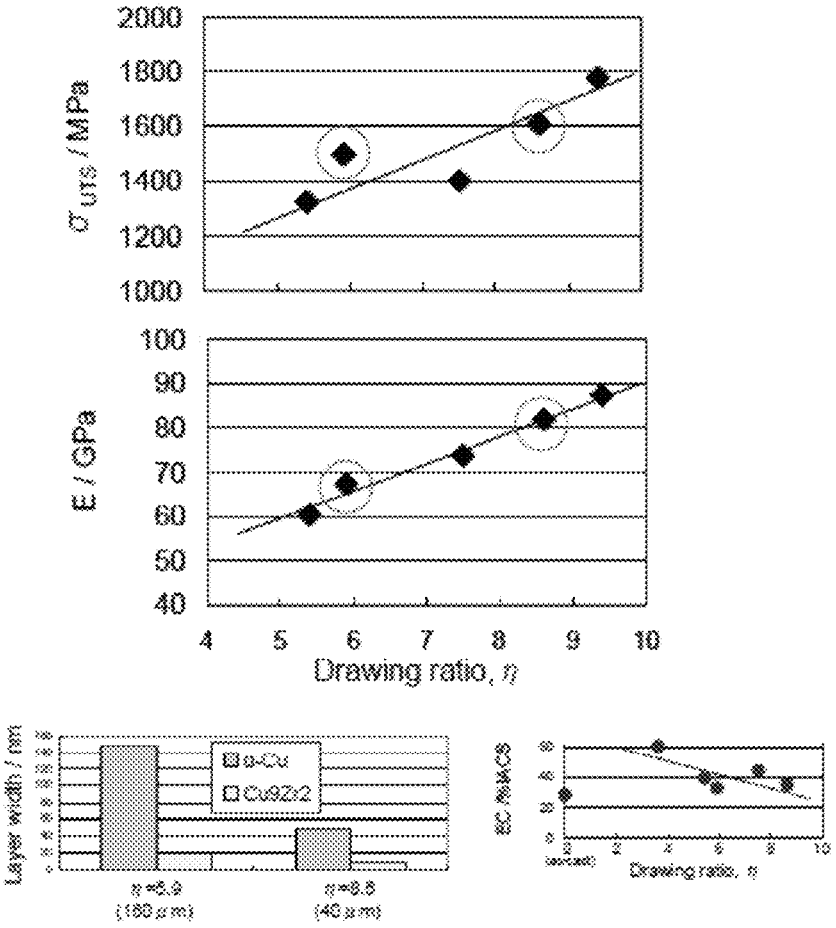
FIG. 30 is a set of graphs showing the relationships between the drawing ratio and the UTS, $\sigma_{0.2}$, structure, and EC of the copper alloy wires containing 4 atomic percent of zirconium.

FIG. 30 is a set of graphs showing the relationships between the drawing ratio and the UTS, $\sigma_{0.2}$, structure, and EC of the copper alloy wires containing 4 atomic percent of zirconium, namely, Examples 30 to 34. It was demonstrated that the strength and the Young's modulus increase with increasing drawing ratio. In addition, a comparison between the examples where $\eta$=5.9 and the examples where $\eta$=8.6 demonstrates that the average widths of the $\alpha$-copper phases and the $Cu_9Zr_2$ compound phases decrease with increasing drawing ratio.

Figure 31:
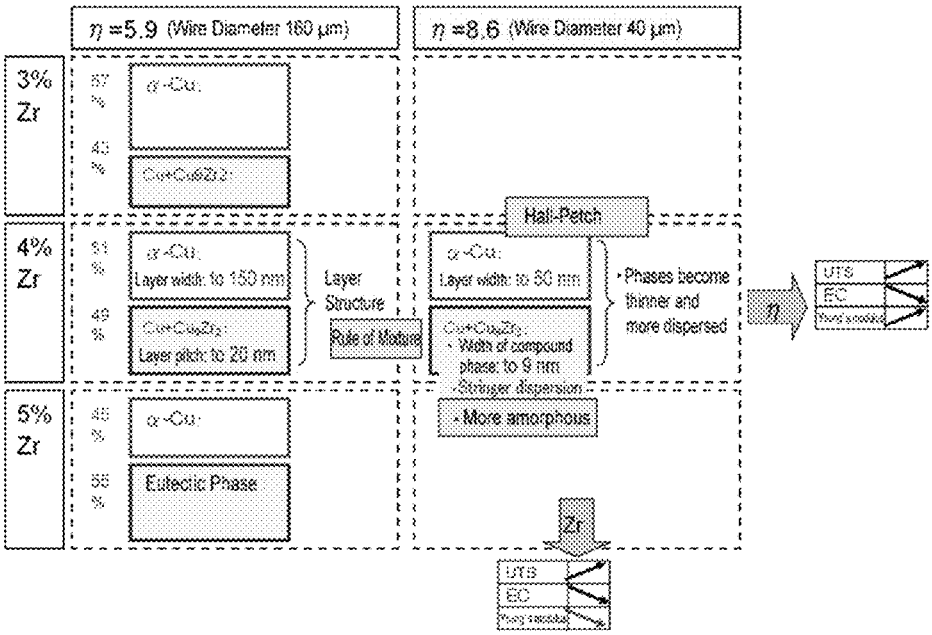
FIG. 31 summarizes the results of the examinations of the relationships between the zirconium content and drawing ratio $\eta$ and the changes in layered structure and properties.

FIG. 31 summarizes the results of the examinations of the relationships between the zirconium content and drawing ratio $\eta$ and the changes in layered structure and properties. It was demonstrated that a copper alloy wire drawn at a higher drawing ratio, such as one drawn at a drawing ratio $\eta$ of 8.6, has a higher ultimate tensile strength. In addition to the improvement in ultimate tensile strength based on the rule of mixture, the following reasons are presumed. For example, presumably the ultimate tensile strength can be increased by the effect similar to the Hall-Petch law because the copper matrix phases are further layered, and can be increased because deformation twins occur in the copper matrix phases. In addition, presumably the ultimate tensile strength can be increased with increasing drawing ratio because, for example, the $Cu_9Zr_2$ compound phases become thinner and more dispersed (stringer dispersion). In addition, the alloy becomes more amorphous with increasing drawing ratio; presumably it enhances the effect of making the alloy more amorphous by the possible presence of oxygen. In addition, presumably the Young's modulus tends to decrease because the alloy tends to become more amorphous as the $Cu_9Zr_2$ phases increase with increasing zirconium content.

Figure 32:
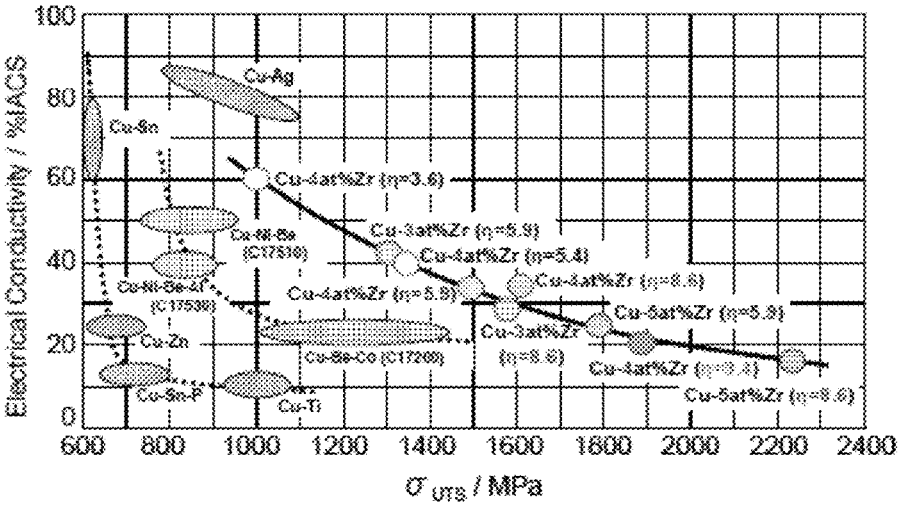
FIG. 32 is a graph showing the relationships between the UTS and EC of the copper alloy wires of Examples 28 to 36 and Comparative Example 6.

Table 5 shows the experimental results of Examples 28 to 36 and Comparative Example 6. Table 5 lists the secondary DAS, the alloy composition, the casting diameter, the drawing diameter, the reduction of area, the drawing ratio, the ultimate tensile strength, and the electrical conductivity. In addition, FIG. 32 is a graph showing the relationships between the UTS and EC of the copper alloy wires of Examples 28 to 36 and Comparative Example 6, together with those of typical known copper alloys for comparison. The results of the copper alloy wires of Examples 28 to 36 and Comparative Example 6 are shown along the solid line. On the other hand, the results of the typical known copper alloys are shown along the broken lines. In general, it is well known that there is a trade-off relationship between UTS and EC: as indicated by the broke lines, the EC decreases shapely with increasing UTS. It was demonstrated, however, that the relationship was gentler for the copper alloy wires of hypoeutectic compositions of Examples 28 to 36 of the present application and Comparative Example 6, as indicated by the solid line, than for the typical known copper alloys. This is because the layered structure could change continuously in association with the drawing ratio ($\eta$) during the wire drawing process, presumably contributing to alleviation of the trade-off relationship between UTS and EC. Whereas a quartz nozzle was used to dissolve the raw material in Examples 28 to 36, presumably the vessel used is not limited thereto and may be a vessel containing quartz. In addition, presumably a vessel containing aluminum may be used. In addition, whereas the molten metal was poured into a copper mold in Examples 1 to 36, presumably it may be directly poured into, for example, a carbon die.

TABLE 5

| | Melting and Casting Steps | | | Wire Drawing Step | | | Wire Property | |
|---|---|---|---|---|---|---|---|---|
| | Alloy Composition at % (Zr) | Casting Diameter mm | Secondary [1] DAS μm | Drawing Diameter mm | Reduction of Area % | Drawing [2] Ratio $\eta$ — | Ultimate Tensile Strength MPa | Electrical [5] Conductivity % IACS |
| Example 28 | 3.0 | 3 | 2.7 | 0.160 | 99.7156 | 5.9 | 1300 | 42 |
| Example 29 | 3.0 | 3 | 2.7 | 0.040 | 99.9822 | 8.6 | 1570 | 29 |
| Example 30 | 4.0 | 3 | — | 0.200 | 99.5556 | 5.4 | 1330 | 40 |
| Example 31 | 4.0 | 3 | — | 0.160 | 99.7156 | 5.9 | 1500 | 33 |
| Example 32 | 4.0 | 3 | — | 0.070 | 99.9456 | 7.5 | 1400 | 42 |
| Example 33 | 4.0 | 3 | — | 0.040 | 99.9822 | 8.6 | 1610 | 34 |
| Example 34 | 4.0 | 3 | — | 0.027 | 99.9919 | 9.4 | 1890 | 21 |
| Example 35 | 5.0 | 3 | — | 0.160 | 99.7156 | 5.9 | 1800 | 23 |
| Example 36 | 5.0 | 3 | — | 0.040 | 99.9822 | 8.6 | 2220 | 16 |
| Comparative Example 6 | 4.0 | 3 | — | 0.500 | 97.2222 | 3.6 | 1000 | 60 |

[1] Secondary dendrite arm spacing
[2] $\eta = \ln(A_0/A_1)$ $A_0$: cross-sectional area before wire drawing; $A_1$: cross-sectional area after wire drawing
[3] Proportion relative to electrical conductivity of annealed pure copper, which is defined as 100%
[4] Indeterminable The present application claims priorities from the Japanese Patent Application No. 2009-212053 filed on Sep. 14, 2009, and the U.S. Provisional Application No. 61/372,185 filed on Aug. 10, 2010, the entire contents of both of which are incorporated herein by reference.

INDUSTRIAL APPLICABILITY

The present invention is applicable in the field of wrought copper products.

The invention claimed is:

1. A copper alloy wire comprising:

copper matrix phases; and composite phases comprising copper-zirconium compound phases and copper phases;

wherein the zirconium content of alloy composition is 3.0 to 7.0 atomic percent;

the copper matrix phases and the composite phases form a matrix phase-composite phase fibrous structure and are arranged alternately parallel to an axial direction as viewed in a cross-section parallel to the axial direction and including a central axis;

the copper-zirconium compound phases and the copper phases in the composite phases form a composite phase inner fibrous structure and are arranged alternately parallel to the axial direction at a phase pitch of 50 nm or less as viewed in the cross-section;

the copper alloy wire contains oxygen in an amount of 700 to 2,000 ppm by mass; and wherein the composite phases contain 5% to 25% of amorphous phases in terms of area fraction as viewed in the cross-section.

2. A copper alloy wire comprising:

copper matrix phases; and composite phases comprising copper-zirconium compound phases and copper phases;

wherein the zirconium content of alloy composition is 3.0 to 7.0 atomic percent;

the composite phases contain 5% to 25% of amorphous phases in terms of area fraction as viewed in a cross-section parallel to an axial direction and including a central axis; and the copper alloy wire contains oxygen in an amount of 700 to 2,000 ppm by mass.

3. The copper alloy wire according to claim 1, wherein the composite phases occupy 40% to 60% of the copper alloy wire in terms of area fraction as observed in a cross-section perpendicular to the axial direction.

4. The copper alloy wire according to claim 1, wherein the copper-zirconium compound phases in the composite phases have an average width of 10 nm or less as viewed in a cross-section parallel to the axial direction and including the central axis.

5. The copper alloy wire according to claim 1, wherein the copper matrix phases comprise a plurality of copper phases forming a copper matrix phase inner fibrous structure and having an average width of 100 nm or less in a cross-section parallel to the axial direction and including the central axis, and contain 0.1% to 5% of deformation twins present at an angle of 20° to 40° with respect to the axial direction so as not to straddle boundaries between the adjacent copper phases.

6. The copper alloy wire according to claim 1, wherein the copper-zirconium compound phases are represented by the general formula $Cu_9Zr_2$ and are amorphous phases in part or the entirety thereof.

7. The copper alloy wire according to claim 1, wherein the copper-zirconium compound phases contain oxygen and silicon and have a mean atomic number Z of 20 to less than 29, the mean atomic number Z being calculated from an elemental composition determined by quantitative measurement of the O—K line, the Si—K line, the Cu—K line, and the Zr-L line using the ZAF method based on EDX analysis; and the copper matrix phases contain no oxygen.

8. The copper alloy wire according to claim 1, wherein the copper alloy wire has an ultimate tensile strength in the axial direction of 1,300 MPa or more and an electrical conductivity of 20% IACS or more.

9. The copper alloy wire according to claim 1, wherein the copper alloy wire has an ultimate tensile strength in the axial direction of 2,200 MPa or more and an electrical conductivity of 15% IACS or more.

10. A method for producing a copper alloy wire, comprising:

(1) a melting step of melting a raw material so as to prepare a copper alloy containing 3.0 to 7.0 atomic percent of zirconium;

(2) a casting step of casting the melt into an ingot having a secondary dendrite arm spacing (secondary DAS) of 10.0 μm or less; and (3) a wire drawing step of cold-drawing the ingot to a reduction of area of 99.00% or more;

wherein the copper alloy wire comprises:

copper matrix phases; and composite phases comprising copper-zirconium compound phases and copper phases; and wherein the copper matrix phases and the composite phases form a matrix phase-composite phase fibrous structure and are arranged alternately parallel to an axial direction as viewed in a cross-section parallel to the axial direction and including a central axis;

the copper-zirconium compound phases and the copper phases in the composite phases form a composite phase inner fibrous structure and are arranged alternately parallel to the axial direction at a phase pitch of 50 nm or less as viewed in the cross-section;

the copper alloy wire contains oxygen in an amount of 700 to 2,000 ppm by mass; and wherein the composite phases contain 5% to 25% of amorphous phases in terms of area fraction as viewed in the cross-section.

11. The method for producing a copper alloy wire according to claim 10, wherein the melt is cast into a bar-shaped ingot having a diameter of 3 to 10 mm using a copper mold in the casting step.

12. A method for producing a copper alloy wire, comprising:

(1) a melting step of melting a raw material so as to prepare a copper alloy containing 3.0 to 7.0 atomic percent of zirconium;

(2) a casting step of casting the melt into a bar-shaped ingot having a diameter of 3 to 10 mm using a copper mold; and (3) a wire drawing step of cold-drawing the ingot to a reduction of area of 99.00% or more;

wherein the copper alloy wire comprises:

copper matrix phases; and composite phases comprising copper-zirconium compound phases and copper phases; and wherein the composite phases contain 5% to 25% of amorphous phases in terms of area fraction as viewed in a cross-section parallel to an axial direction and including a central axis; and the copper alloy wire contains oxygen in an amount of 700 to 2,000 ppm by mass.

13. The method for producing a copper alloy wire according to claim 10, wherein shear wire drawing is performed in the wire drawing step.

14. The method for producing a copper alloy wire according to claim 10, wherein the raw material contains 700 to 2,000 ppm by mass of oxygen in the melting step.

15. The method for producing a copper alloy wire according claim 10, wherein the raw material is melted using a vessel containing silicon or aluminum in the melting step.

16. The method for producing a copper alloy wire according to claim 10, wherein the raw material is melted while injecting an inert gas so as to apply a pressure of 0.5 to 2.0 MPa to the raw material in the melting step; and the melt is poured while injecting the inert gas so as to apply a pressure of 0.5 to 2.0 MPa to the raw material in the casting step continuously after the melting step.

17. The method for producing a copper alloy wire according to claim 15, wherein the vessel has a tap hole in a bottom surface thereof.

18. The method for producing a copper alloy wire according to claim 10, wherein the metal melted in the melting step is poured into a copper mold or a carbon die in the casting step.

19. The method for producing a copper alloy wire according to claim 10, wherein the melt is solidified in the casting step by quenching so that, according to results of an analysis by the EDX-ZAF method, the amount of zirconium contained in copper matrix phases in the ingot at room temperature after the solidification is supersaturated at 0.3 atomic percent or more.

20. The method for producing a copper alloy wire according to claim 10, wherein the ingot is cold-drawn to a reduction of area of 99.00% or more through one or more drawing passes in the wire drawing step, at least one of the drawing passes having a reduction of area of 15% or more.

21. The method for producing a copper alloy wire according to claim 10, wherein the wire drawing is performed in the wire drawing step after cooling at least one of the material and equipment for wire drawing to a temperature lower than room temperature.

* * * * *